US010927650B2

(12) United States Patent
Schultz et al.

(10) Patent No.: US 10,927,650 B2
(45) Date of Patent: Feb. 23, 2021

(54) PERFORATING SYSTEMS AND FLOW CONTROL FOR USE WITH WELL COMPLETIONS

(71) Applicant: THRU TUBING SOLUTIONS, INC., Oklahoma City, OK (US)

(72) Inventors: Roger L. Schultz, Newcastle, OK (US); Randy C Tolman, Spring, TX (US); Andrew M. Ferguson, Moore, OK (US)

(73) Assignee: THRU TUBING SOLUTIONS, INC., Oklahoma City, OK (US)

( * ) Notice: Subject to any disclaimer, the term of this patent is extended or adjusted under 35 U.S.C. 154(b) by 70 days.

(21) Appl. No.: 16/375,389

(22) Filed: Apr. 4, 2019

(65) Prior Publication Data

US 2019/0316449 A1 Oct. 17, 2019

Related U.S. Application Data

(60) Provisional application No. 62/655,875, filed on Apr. 11, 2018.

(51) Int. Cl.
*E21B 43/116* (2006.01)
*E21B 23/08* (2006.01)
(Continued)

(52) U.S. Cl.
CPC ..... *E21B 43/116* (2013.01); *E21B 23/08* (2013.01); *E21B 43/26* (2013.01); *E21B 47/06* (2013.01);
(Continued)

(58) Field of Classification Search
CPC ..... E21B 43/116; E21B 47/107; E21B 43/26; E21B 33/13; E21B 47/09; E21B 47/06;
(Continued)

(56) References Cited

U.S. PATENT DOCUMENTS 9,903,178 B2 2/2018 Sewell
2004/0020709 A1* 2/2004 Wilson ..... E21B 33/1275 181/103

(Continued)

FOREIGN PATENT DOCUMENTS

WO 2007008637 A1 1/2007

OTHER PUBLICATIONS

International Search Report with Written Opinion dated Jul. 22, 2019 for PCT Patent Application No. PCT/US2019/025775, 19 pages.

*Primary Examiner* — Brad Harcourt
(74) *Attorney, Agent, or Firm* — Smith IP Services, P.C.

(57) ABSTRACT

A well completion system can include fluid flow through a flow passage, and one or more diverters deployed into the flow passage downhole of a perforating assembly, the diverters and the perforating assembly being concurrently displaced by the fluid flow. A perforating assembly can include a perforator, and a control module including a memory, a motion sensor, a timer, and a controller that causes the perforator to fire in response to a lack of motion for a predetermined period of time. A well completion method can include flowing fluid through a flow passage, deploying a perforating assembly into the flow passage, and displacing the perforating assembly through the flow passage by the fluid flow at a predetermined flow rate for a predetermined flow time, and ceasing the fluid flow at an end of the predetermined flow time, thereby placing the perforating assembly at a desired location for forming perforations.

90 Claims, 21 Drawing Sheets

(51) Int. Cl.

| | |
|---|---|
| ***E21B 43/26*** | (2006.01) |
| ***E21B 47/09*** | (2012.01) |
| ***E21B 47/06*** | (2012.01) |
| ***E21B 47/107*** | (2012.01) |
| *E21B 33/13* | (2006.01) |
| *E21B 33/12* | (2006.01) |
| *E21B 27/02* | (2006.01) |
| *E21B 47/18* | (2012.01) |

(52) U.S. Cl.
CPC ..... *E21B 47/09* (2013.01); *E21B 47/107* (2020.05); *E21B 27/02* (2013.01); *E21B 33/12* (2013.01); *E21B 33/13* (2013.01); *E21B 47/18* (2013.01)

(58) Field of Classification Search
CPC ..... E21B 33/12; E21B 27/02; E21B 47/18; E21B 43/119; E21B 23/08; E21B 23/10
See application file for complete search history.

(56) References Cited

U.S. PATENT DOCUMENTS

| | | | | |
|---|---|---|---|---|
| 2013/0062055 | A1 | 3/2013 | Tolman et al. | |
| 2013/0138254 | A1* | 5/2013 | Seals | E21B 7/068 700/282 |
| 2013/0255939 | A1 | 10/2013 | Kumaran et al. | |
| 2014/0158350 | A1* | 6/2014 | Castillo | E21B 23/10 166/250.17 |
| 2015/0285029 | A1 | 10/2015 | Tolman et al. | |
| 2016/0040520 | A1* | 2/2016 | Tolman | E21B 33/124 166/308.1 |
| 2016/0305210 | A1 | 10/2016 | Flores et al. | |

* cited by examiner

PERFORATING SYSTEMS AND FLOW CONTROL FOR USE WITH WELL COMPLETIONS

BACKGROUND

This disclosure relates generally to equipment and techniques used in conjunction with a subterranean well and, in an example described below, more particularly provides perforating systems and flow control for use with well completions.

Perforating systems are designed to form perforations through a well casing or other wellbore lining. The perforations permit fluid communication between an earth formation penetrated by the wellbore and an interior of the casing. In this manner, fluids can be produced from the formation into the casing and then to surface. In other examples, fluids can be injected from the interior of the casing into the formation via the perforations.

It will, therefore, be readily appreciated that improvements are continually needed in the arts of constructing and operating perforating systems, and controlling flow through perforations. Such improvements can be useful in a wide variety of different types of well completions.

DETAILED DESCRIPTION

Figure 1A:
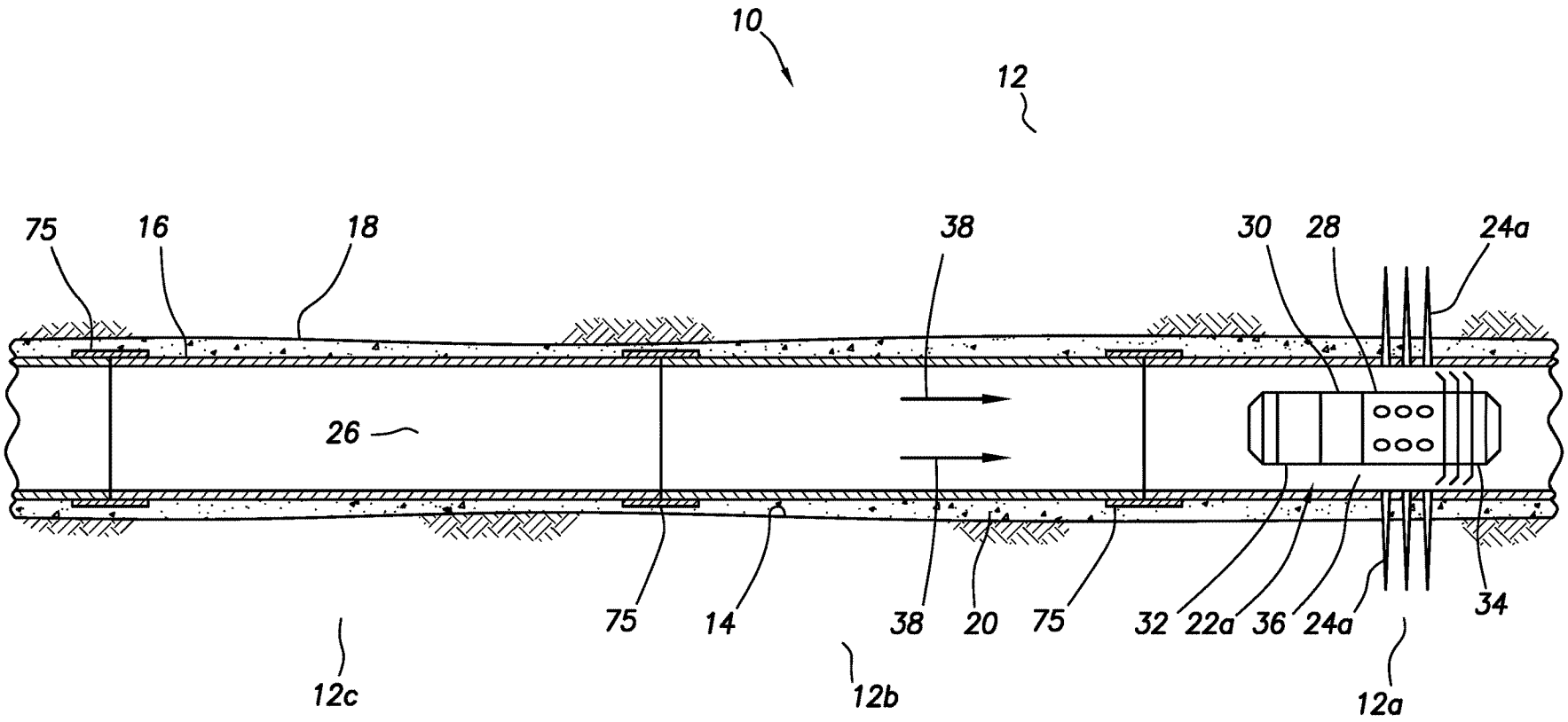
FIGS. 1A-D are representative partially cross-sectional views of successive steps in an example of a well completion system and associated method which can embody principles of this disclosure.

Representatively illustrated in FIGS. 1A-D is a well completion system 10 and associated method for use with a subterranean well, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

Using the system 10, multiple zones 12*a-c* of an earth formation 12 penetrated by a wellbore 14 are to be individually perforated and fractured. Although three zones 12*a-c* are depicted in the drawings and described herein, any number of zones may be completed using the system 10 and method. In addition, although the zones 12*a-c* in the FIGS. 1A-D system 10 and method are completed individually, in other examples multiple zones could be simultaneously completed.

In the FIGS. 1A-D example, the wellbore 14 is lined with casing 16 and cement 18. The casing 16 could be any type of segmented, continuous or formed in situ tubular or wellbore liner, including (but not limited to) the types known to those skilled in the art as casing, liner, tubing, pipe, etc. The scope of this disclosure is not limited to use of any particular type of casing, or to use of any casing in the formation 12.

The cement 18 could be a Portland cement composition or any other type of seal or sealant for isolating the zones 12*a-c* from each other in an annulus 20 formed between the wellbore 14 and the casing 16. In other examples, external casing packers, swellable seals or other sealing devices could be used in place of the cement 18. The scope of this disclosure is not limited to use of any particular type of cement, or to use of any cement in the formation 12.

The wellbore 14 is illustrated in the figures as being generally horizontal or highly deviated from vertical. Although the system 10 and method provide certain advantages in situations where a well completion is to be performed in a horizontal or highly deviated wellbore, the wellbore 14 could be generally vertical or otherwise deviated in keeping with the scope of this disclosure.

As depicted in FIG. 1A, a perforating assembly 22*a* is displaced to a location in the wellbore 14 at which it is desired to form perforations 24*a* through the casing 16 and cement 18, in order to establish fluid communication between the zone 12*a* and an interior flow passage 26 of the casing. Although the perforating assembly 22*a* and the perforations 24*a* are both depicted in FIG. 1A, in some examples the perforating assembly 22*a* may break up, disintegrate, dissolve, disperse, degrade or otherwise cease to exist as a distinct structural entity as/once the perforations 24*a* are/have been formed.

For example, the perforating assembly 22*a* could be made up of materials that are friable, frangible, dissolvable, subject to galvanic corrosion, or otherwise dispersible or degradable in a well environment. The disintegration, dispersal, degrading, dissolution, etc., of the perforating assembly 22*a* may begin at any point in the method, such as, at introduction of the perforating assembly into the well, in response to contact with a particular activating fluid (for example, a fluid having a particular pH level or chemical composition) already present or later introduced into the well or released from a container, in response to shock produced when a perforator 28 of the perforating assembly is fired to form the perforations 24*a*, in response to exposure to an elevated temperature or pressure, or in response to another event or stimulus (or combination of events and/or stimuli). However, note that it is not necessary for the perforating assembly 22*a* to break up, disintegrate, dissolve, disperse, degrade or otherwise cease to exist as a distinct structural entity in keeping with the scope of this disclosure.

In the FIG. 1A example, the perforating assembly 22*a* includes the perforator 28, a firing head 30, a control module 32 and a flow restrictor 34. In other examples, the perforating assembly 22*a* could include other, different, more or less components. The scope of this disclosure is not limited to use of any particular components or combination of components in a perforating assembly.

Figure 2:
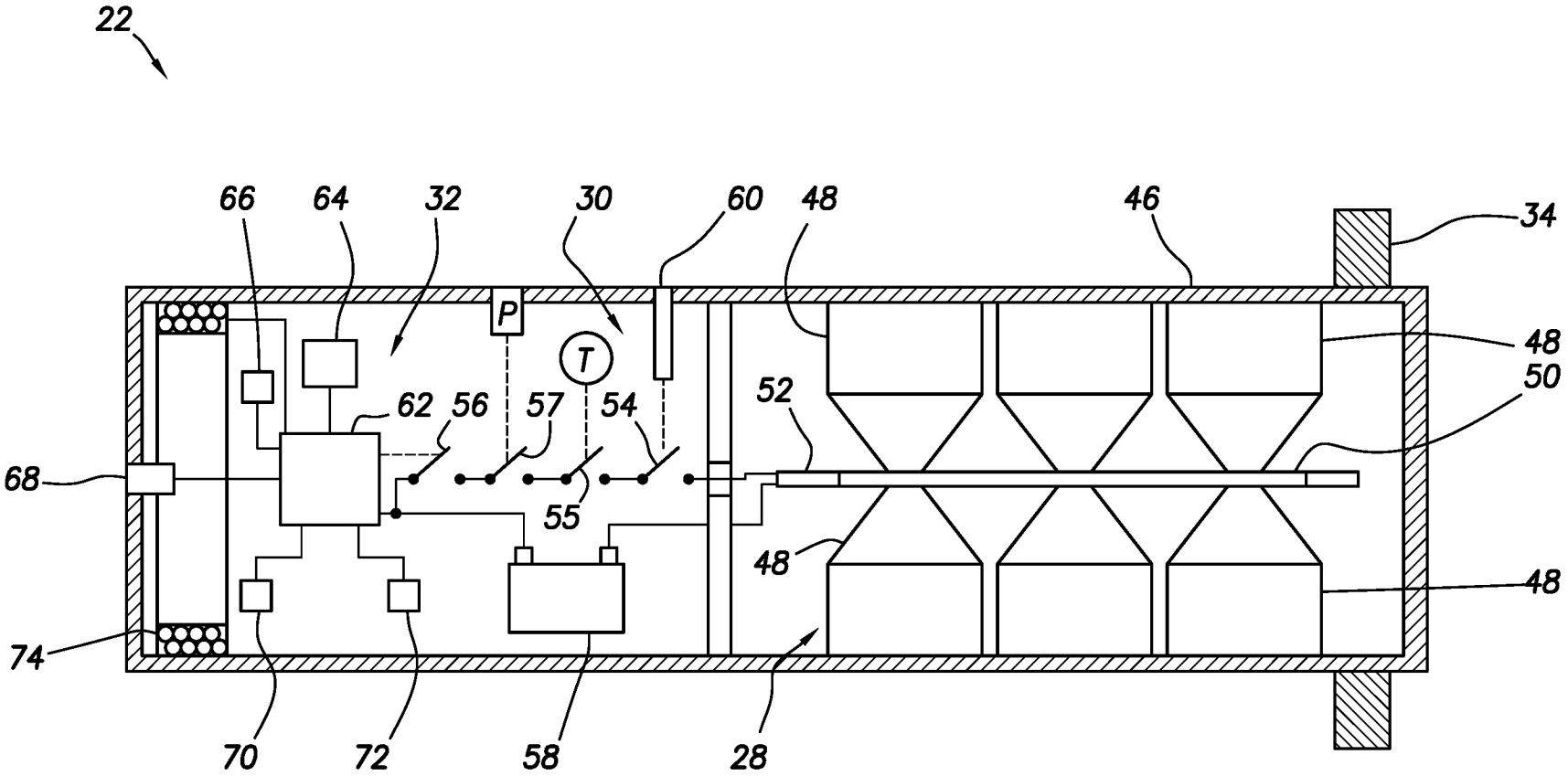
FIG. 2 is a representative partially cross-sectional view of an example of a perforating assembly that may be used in the FIGS. 1A-D system and method, and which can embody the principles of this disclosure.

The perforator 28 in this example comprises an explosive shaped charge-type perforator or perforating gun, in which one or more explosive shaped charges are contained in an outer tubular gun body (see FIG. 2). The shaped charges are detonated, in order to form the perforations 24*a*. Other types of perforators (such as, drills, bullet-type perforating guns, etc.) may be used in other examples.

The firing head 30 in this example functions to detonate the shaped charges in the perforator 28 when desired, for example, by initiating detonation of a detonating cord extending to each of the shaped charges. The firing head 30 may initiate the detonation mechanically, electrically, chemically or in any other manner, or in response to any event, stimulus or condition (or any combination of events, stimuli and/or conditions). The scope of this disclosure is not limited to use of any particular type of firing head.

The control module 32 in this example is used to control when or if the perforator 28 is fired, such as, by controlling when or if the firing head 30 detonates the shaped charges. The control module 32 may cause the firing head 30 to fire the perforator 28 in response to any predetermined number or combination of events, stimuli or conditions, such as, elapse of time, pressure or pattern of pressure variations, flow or pattern of flow variations, temperature, vibration or pattern of vibration changes, acceleration or pattern of acceleration variations, etc. The scope of this disclosure is not limited to any particular number or combination of events, stimuli or conditions that will cause the control module to activate the firing head 30.

The flow restrictor 34 in this example is used to restrict flow through an annulus 36 formed radially between the perforating assembly 22*a* and the casing 16. As depicted in FIG. 1A, the flow restrictor 34 comprises multiple swab cups or cup-type packers that do not necessarily fully seal against the casing 16, but that do at least substantially restrict flow through the annulus 36 past the perforating assembly 22*a* (although the flow restrictor could seal against the casing, if desired).

In other examples, the flow restrictor 34 could be in the form of a tortuous path, outwardly extending stiff fibers or bristles, or a gauge ring or other enlarged diameter on the perforating assembly 22*a*. In further examples, the perforating assembly 22*a* could be dimensioned so that flow through the annulus 36 is significantly restricted, without use of a separate flow restrictor. Thus, the scope of this disclosure is not limited to use of any particular type of flow restrictor, or to use of a flow restrictor at all in the perforating assembly 22*a*.

Although the perforator 28, firing head 30, control module 32 and flow restrictor 34 are depicted in the drawings as being separate connected-together components of the perforating assembly 22*a*, in other examples any or all of the perforating assembly components could be integral or combined. For example, the firing head 30 and control module 32 could be a single integrated component, the perforator 28, firing head, control module and flow restrictor 34 could be combined in a single outer housing, etc. Thus, the scope of this disclosure is not limited to any particular structural form of the perforating assembly 22*a*.

In the FIG. 1A example, the perforating assembly 22*a* is displaced, transported or conveyed to the desired location for forming the perforations 24*a* by a flow of fluid 38 in the flow passage 26. The fluid 38 may be pumped through the flow passage 26 by use of one or more pumps at surface (see FIG. 14). However, the scope of this disclosure is not limited to use of fluid flow to convey the perforating assembly 22*a*, to use of pumps to cause the fluid flow, or to use of pumps at any particular location.

The perforating assembly 22*a* may be conveyed to a desired location by flowing a corresponding volume of the fluid 38 through the flow passage 26. In a simplified example, the volume of fluid required to displace the perforating assembly 28 a certain distance is given by the formula: $V=A\times D$, in which V is the required volume, A is the cross-sectional area of the flow passage 26, and D is the distance to the desired location.

As those skilled in the art will appreciate, this simplified example does not account for variations in the flow passage 26 cross-sectional area, leakage of the fluid 38 past the flow restrictor 34, etc. Described more fully below is a "calibration" method whereby the volume required to displace the perforating assembly 22*a* to a desired location along the wellbore 14 can be determined (see FIG. 15).

Once it is known what volume of the fluid 38 is required to be flowed through the flow passage 26 to displace the perforating assembly 22*a* to the desired location, this volume may be measured by use of various techniques or equipment, such as, by counting pump strokes, by use of a flow meter, etc. The scope of this disclosure is not limited to use of any particular technique or equipment for measuring the volume of the fluid 38.

Once the perforating assembly 22*a* is at the desired location for forming the perforations 24*a*, the perforator 28 is fired to thereby form the perforations. In one example, the control module 32 may be configured to require the perforating assembly 22*a* to remain motionless for a predetermined period of time, prior to the perforator 28 being fired. In other examples, the control module 32 could cause the firing head 30 to fire the perforator 28 immediately upon detecting that the perforating assembly 22*a* is positioned at the desired location, whether or not the perforating assembly is motionless. The scope of this disclosure is not limited to any particular combination or sequence of events, stimuli or conditions that will cause the perforator 28 to be fired at the desired location.

Figure 1B:
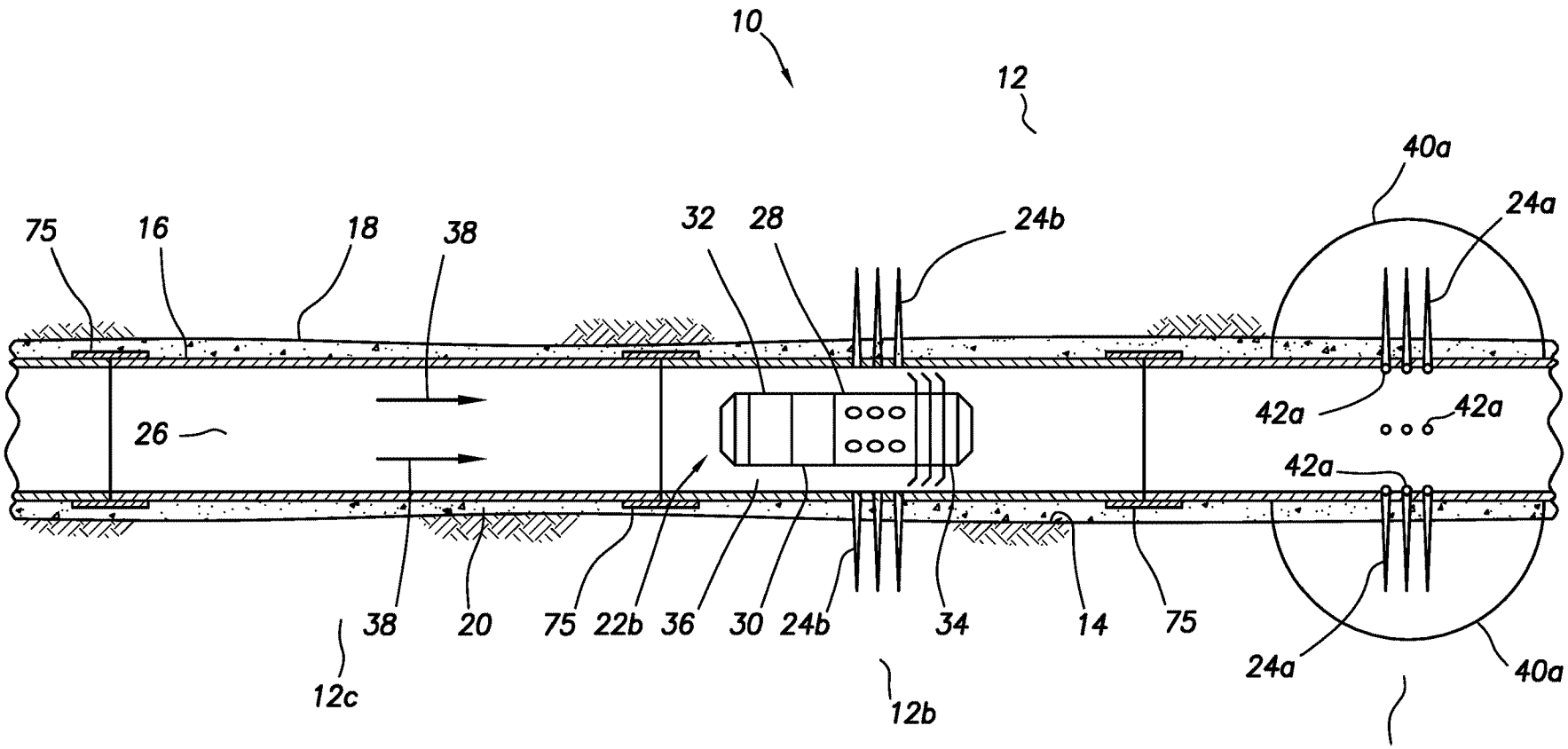

Referring additionally now to FIG. 1B, the zone 12*a* is fractured after the perforations 24*a* are formed. To fracture the zone 12*a*, a fracturing fluid is pumped under elevated pressure from the flow passage 26, through the perforations 24*a* and into the zone 12*a*, until the earth fractures (see fractures 40*a* depicted in FIG. 1B).

The fracturing fluid may be the same as, or may be pumped concurrently with, the fluid 38 used to displace the perforating assembly 22*a* through the flow passage 26. Thus, the zone 12*a* can be fractured immediately after the perforations 24*a* are formed. In other examples, the fracturing fluid could be different from the fluid 38, or the fractures 40*a* may not be formed immediately after the perforations 24*a* are formed (for example, a period of time may elapse after the perforations are formed, e.g., to allow sufficient time for the perforating assembly 22*a* to dissolve, degrade, be dispersed, etc., prior to the fracturing operation). The scope of this disclosure is not limited to any particular timing, combination or sequence of events associated with forming the perforations 24*a* and the fractures 40*a*.

In addition to the actual fracturing of the zone 12*a*, the fracturing operation may include a variety of different techniques or procedures of the type well known to those skilled in the art. For example, various stages may be pumped as part of the fracturing operation, such as, including pads, gels, breakers, proppant, stimulation fluids, conformance agents, permeability enhancers, etc. The scope of this disclosure is not limited to use of any particular number or combination of fluids, substances or other agents in procedures associated with the fracturing operation.

After or during the fracturing operation (including any associated propping, breaking, stimulating, conformance or other procedures), one or more plugs or diverters 42*a* is/are used to isolate the zone 12*a* from pressure in the flow passage 26, so that further fracturing of the zone is prevented. The diverter(s) 42*a* may plug the perforations 24*a* during the fracturing operation (e.g., so that flow is diverted from perforations taking more flow to perforations taking less flow), or the diverter(s) may plug the perforations at the conclusion of the fracturing operation. The scope of this disclosure is not limited to any particular timing of the diverter(s) 42*a* preventing outward flow through any or all of the perforations 24*a*.

The diverter(s) 42*a* may be any type of plugging device or substance capable of entirely preventing or substantially restricting flow outward into the zone 12*a* via the perforations 24*a*. The diverter(s) 42*a* could in some examples be discrete plugging devices, such as, frac balls or those plugging devices described more fully in U.S. Pat. Nos. 9,523,267, 9,567,824, 9,567,825, 9,567,826, 9,708,883, 9,816,341, or in U.S. application Ser. Nos. 15/567,779, 15/138,685, 15/138,968, 15/615,136 or 15/609,671. The discrete plugging devices may be dispensed into the flow passage 26 using any of the techniques described more fully in the above-mentioned US patents and applications, or in U.S. application Ser. Nos. 15/745,608, 15/162,334, 15/837,502, 62/588,150 or 62/638,059. The entire disclosures of the above-listed US patents and applications are hereby incorporated herein, for any purpose, by this reference. However, it should be clearly understood that discrete plugging devices and dispensing techniques other than those described in the above-listed patents and application may be used, in keeping with the scope of this disclosure.

The diverter(s) 42*a* could in some examples be in particulate, gel or other non-discrete form. For example, substances such as sand, calcium carbonate, poly-lactic acid (PLA), ploy-glycolic acid (PGA), polyvinyl alcohol (PVA), anhydrous boron compounds, particulate nylon, etc., may be used. Many such plugging substances are described in the US patents and applications listed above, although other substances may be used in other examples.

The diverter(s) 42*a* may be dissolvable, dispersible, meltable, corrodible, or otherwise degradable in the well. The diverter(s) 42*a* may self-degrade, or a particular activating fluid or other condition or stimulus may be required to cause the diverter(s) to degrade. In some examples, the diverter(s) 42*a* may comprise a mixture or combination of degradable and non-degradable materials. In other examples, the diverter(s) 42*a* may not be degradable in the well at all. The scope of this disclosure is not limited to any particular form, composition or degradability of the diverter(s) 42*a*.

The diverter(s) 42*a* may enter the perforations 24*a* and seal against a surface or face of the zone 12*a* or the fractures 40*a*. In other examples, the diverter(s) 42*a* may seal off the perforations 24*a* at an interior of the casing 16, as depicted in FIG. 1B. The scope of this disclosure is not limited to any particular location at which the diverter(s) 42*a* prevent flow into the zone 12*a*.

As depicted in FIG. 1B, another perforating assembly 22*b* has been conveyed or displaced to a desired location for forming perforations 24*b* into the zone 12*b*. The perforating assembly 22*b* may be the same as, or different in some respects from, the perforating assembly 22*a*.

The perforating assembly 22*b* may be conveyed or displaced to the desired location in the same manner as described above for the perforating assembly 22*a* (such as, by flowing a particular volume of the fluid 38 through the flow passage 26), or the perforating assembly 22*b* could be conveyed or displaced using another technique (such as, using wireline, slickline, coiled tubing, jointed tubing, a downhole tractor, etc.).

The perforating assembly 22*b* may be conveyed or displaced to the location for forming the perforations 24*b* after or while the fractures 40*a* are being formed, or after or while the diverter(s) 42*a* are being used to prevent flow into the zone 12*a*. For example, the perforating assembly 22*b* could be introduced into the well and displaced through the wellbore 14 by flow of the fluid 38 while the fluid is also being used to form the fractures 40*a* or place the diverter(s) 42*a*. Thus, the scope of this disclosure is not limited to any particular relative timing between conveyance of the perforating assembly 22*b*, forming the fractures 40*a* and placing the diverter(s) 42*a*.

The zone 12*b* is fractured after the perforations 24*b* are formed. To form fractures 40*b* in the zone 12*b* (see FIG. 1C), a fracturing fluid is pumped under elevated pressure from the flow passage 26, through the perforations 24*b* and into the zone 12*b*. The fracturing fluid and associated fracturing operation may be the same as, or different from, that described above for forming the fractures 40*a* in the zone 12*a*.

After or during the fracturing operation (including any associated propping, breaking, stimulating, conformance or other procedures), one or more plugs or diverters 42*b* (see FIG. 1C) is/are used to isolate the zone 12*b* from pressure in the flow passage 26, so that further fracturing of the zone is prevented. The diverter(s) 42*b* may be the same as, or different from, the diverter(s) 42*a* described above.

Figure 1C:
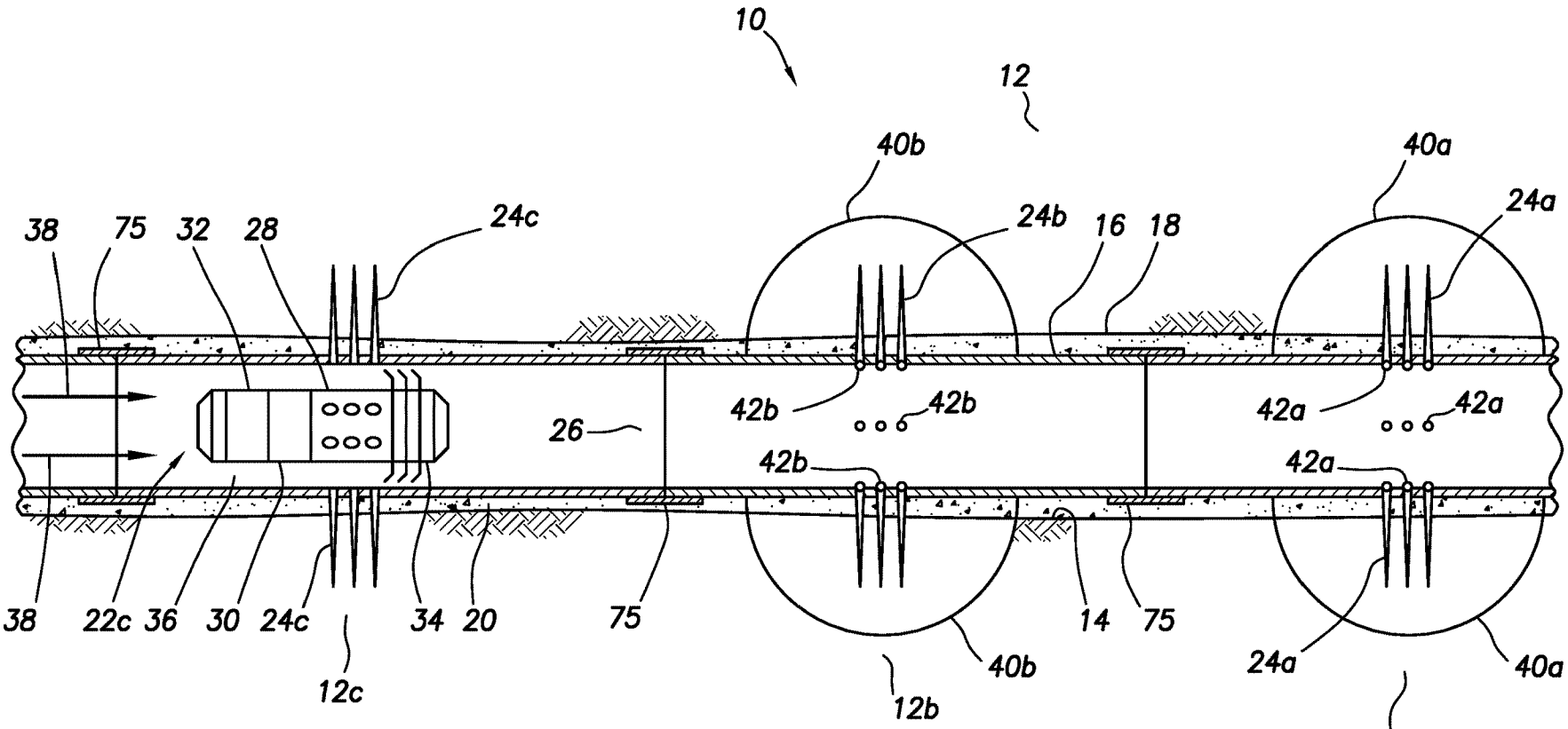

Referring additionally now to FIG. 1C, another perforating assembly 22*c* has been conveyed or displaced to a desired location for forming perforations 24*c* into the zone 12*c*. The perforating assembly 22*c* may be the same as, or different in some respects from, the perforating assemblies 22*a,b* described above.

The perforating assembly 22*c* may be conveyed or displaced to the desired location in the same manner as described above for the perforating assemblies 22*a,b*, or the perforating assembly 22*c* could be conveyed or displaced using another technique. The perforating assembly 22*c* may be conveyed or displaced to the location for forming the perforations 24*c* after or while the fractures 40*b* are being formed, or after or while the diverter(s) 42*b* are being used to prevent flow into the zone 12*b*.

Figure 1D:
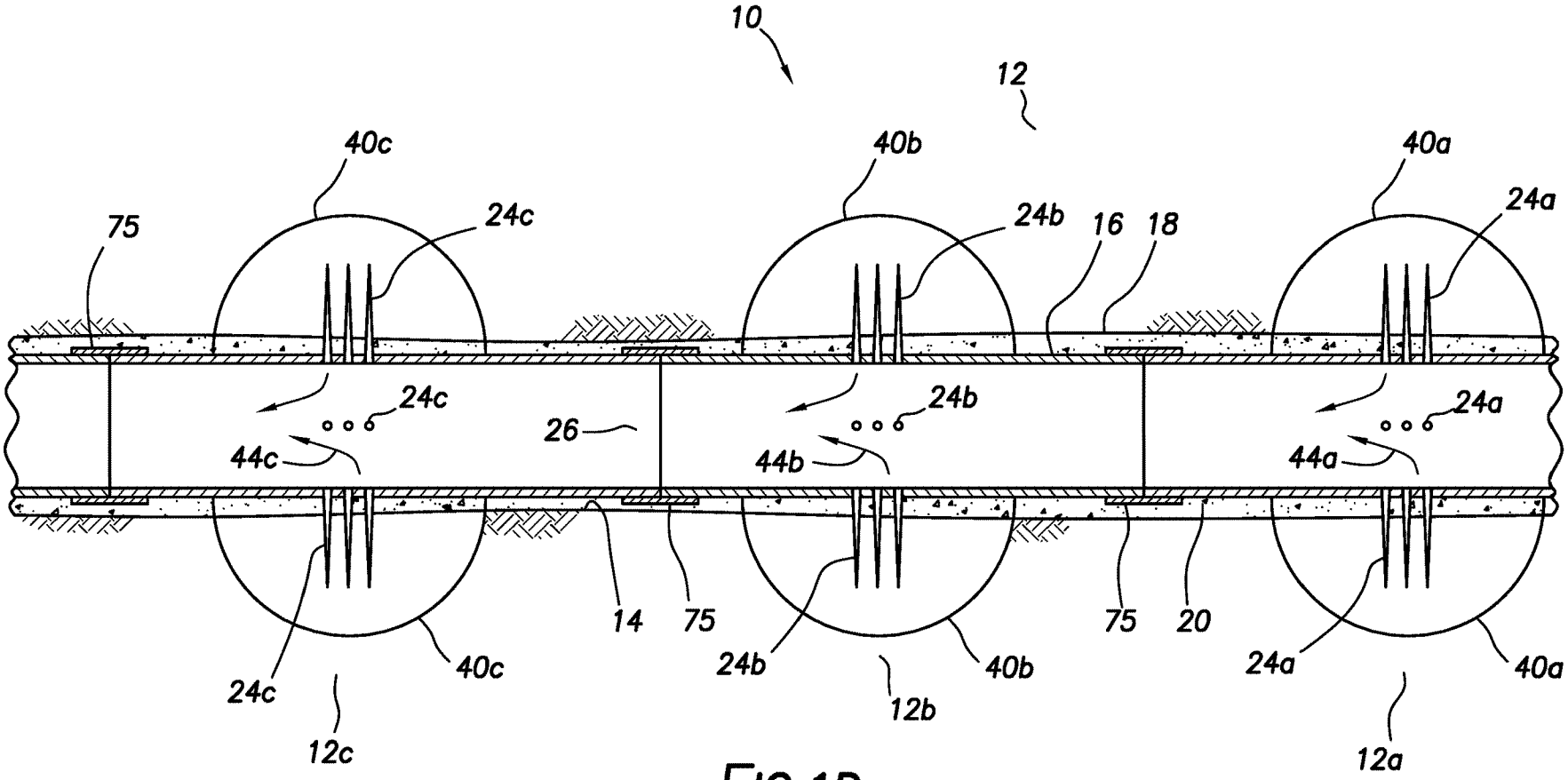

Referring additionally now to FIG. 1D, the zone 12*c* is fractured after the perforations 24*c* are formed. To form fractures 40*c* in the zone 12*c*, a fracturing fluid is pumped under elevated pressure from the flow passage 26, through the perforations 24*c* and into the zone 12*c*. The fracturing fluid and associated fracturing operation may be the same as, or different from, that described above for forming the fractures 40*a,b* in the respective zones 12*a,b*.

The diverter(s) 42*a,b* may dissolve, melt, corrode, disperse or otherwise degrade after the zones 12*a-c* have been fractured. In some examples, the diverter(s) 42*a,b* may flow to surface with fluids 44*a-c* produced from the respective zones 12*a-c*. The scope of this disclosure is not limited to any particular technique or process for permitting flow between the zones 12*a-c* and the flow passage 26 after all of the zones have been fractured. Note that, in some examples, the well may be an injection well instead of, or in addition to, a production well, in which case production of the fluids 44*a-c* may not be an ultimate goal of the well completion.

Referring additionally now to FIG. 2, an example of a perforating assembly 22 that may be used for any of the perforating assemblies 22*a-c* in the system 10 and method examples described herein is representatively illustrated. In the FIG. 2 example, the perforator 28, firing head 30 and control module 32 are contained in a same generally tubular outer housing 46, but in other examples separate housings may be used. The scope of this disclosure is not limited to any particular details of the perforating assembly 22 as described herein or depicted in the drawings.

The perforator 28 in the FIG. 2 example comprises multiple explosive shaped charges 48, a detonating cord 50 and an electrical detonator 52. When an electric current is applied to the detonator 52, the detonator detonates and thereby initiates an explosive chain reaction, in which the detonating cord 50 detonates and thereby causes the shaped charges 48 to detonate.

The shaped charges 48, detonating cord 50 and detonator 52 can be conventional components of the type well known to those skilled in the art, and so they are not described further herein. However, it should be understood that other mechanisms or techniques (such as, bullet-type perforators, percussive detonators, drills, etc.) may be used to form perforations, without departing from the scope of this disclosure.

The firing head 30 in the FIG. 2 example includes electrical switches 54, 56 connected in series between a battery 58 and the detonator 52. The switch 54 is a fail-safe switch for absolutely preventing electrical current from flowing through the detonator 52, unless the switch is activated.

A mechanical or other type of safety mechanism 60 may be used to prevent activation of the switch 54, for example, during transport of the perforating assembly 22 to a wellsite, or immediately prior to deployment of the perforating assembly 22 into a well. In some examples, the fail-safe switch 54 could be a three-way switch that electrically connects electrical leads of the detonator 52 to each other, to thereby preclude an electrical potential from being created across the leads, until the switch is activated by the safety mechanism 60.

Additional switches 55, 57 may be connected in series with the fail-safe switch 54 between the controller-actuated switch 56 and the detonator 52. In the example depicted in FIG. 2, the switch 55 is a temperature-actuated switch and the switch 57 is a pressure-actuated switch. The temperature-actuated switch 55 is configured so that it closes only when a temperature of the perforating assembly 22 or its surrounding environment is greater than ambient surface temperature (such as, an expected downhole temperature). The pressure-actuated switch 57 is configured so that it closes only when pressure external to the perforating assembly 22 is greater than atmospheric pressure (such as, an expected downhole pressure). In this manner, an electrical potential cannot be created across the detonator 52 unless the perforating assembly 22 is positioned downhole.

After the fail-safe switch 54 is activated, the switch 56 can be activated by the control module 32 downhole. In this example, the control module 32 comprises a controller 62, a memory 64, a clock or timer 66, a pressure sensor 68, a temperature sensor 70 and an accelerometer or other type of motion sensor 72. An optional collar locator 74 may be included in some examples.

The controller 62 may be a programmable logic controller (PLC), or another type of controller capable of activating the switch 56 in response to a pre-programmed combination of events, stimuli or conditions as sensed, determined or measured using the timer 66, pressure sensor 68, temperature sensor 70, motion sensor 72 and/or collar locator 74. The memory 64 may be used to store the combination of events, stimuli or conditions.

The memory 64 may in some examples be used to store well parameters, such as, casing collar 75 locations, expected downhole temperatures, expected hydrostatic pressures, desired perforating location, etc. In this manner, the perforating assembly 22 can be programmed so that it fires in response to events, stimuli or conditions (or combination thereof) unique to a particular well completion, including unique to a particular zone to be perforated.

In one example, the memory 64 may store instructions that cause the controller 62 to activate the switch 56 only after a certain minimum amount of time has elapsed since the perforating assembly 22 was deployed into the well (as measured by the timer 66), only if a certain level of pressure is detected by the pressure sensor 68, only if a certain level of temperature is detected by the temperature sensor 70, and only if the perforating assembly 22 has remained motionless for a certain period of time (e.g., as detected using the motion sensor 72 and the timer 66).

If the collar locator 74 is included in the control module 32, the controller 62 may in addition only activate the switch 56 if a certain number of casing collars 75 (see FIGS. 1A-D) have been detected. Alternatively, or in addition, the controller 62 may only activate the switch 56 if the perforating assembly 22 has remained motionless for a certain period of time as indicated by a lack of collars 75 (or other ferromagnetic anomalies) being detected by the collar locator 74.

In other examples, different numbers and/or combinations of sensors, memory, controllers, switches, etc., may be used in the control module 32. Thus, the scope of this disclosure is not limited to any particular configuration of the control module 32.

The flow restrictor 34 in the FIG. 2 example is in the form of a gauge ring or other enlarged diameter secured on the outer housing 46. In other examples, the enlarged diameter could be formed as part of the outer housing 46.

Although not depicted in FIG. 2, the perforating assembly 22 could include a self-destruct capability, so that the perforating assembly disintegrates, dissolves, breaks apart or otherwise degrades, if it is not properly fired at the desired location in the well (such as, if the sensors 66, 68, 70, 72, 74 do not detect a pre-programmed set of events, conditions or stimuli). For example, the perforating assembly 22 could include a separate explosive charge or a container of activating fluid (such as an acid or corrosive fluid), whereby the explosive charge is detonated or the activating fluid is released in the perforating assembly after a certain period of time has elapsed (the period of time being greater than that at which it was expected that the pre-programmed set of events, conditions or stimuli would occur). As another example, an opening could be created in the outer housing 46 (e.g., using the explosive charge or container of activating fluid after the certain period of time has elapsed without the perforating assembly being properly fired at the desired location in the well), so that the perforating assembly 22 is flooded with wellbore fluid to disable the charges 48, detonating cord 50, detonator 52, etc., downhole.

The self-destruct capability can prevent a "live" perforating assembly from being left downhole or retrieved to surface in an unknown or unsafe state. Alternatively, if, for example, the perforating assembly 22 can reliably be dissolved or otherwise degraded downhole, the self-destruct capability may not be used.

Figure 3A:
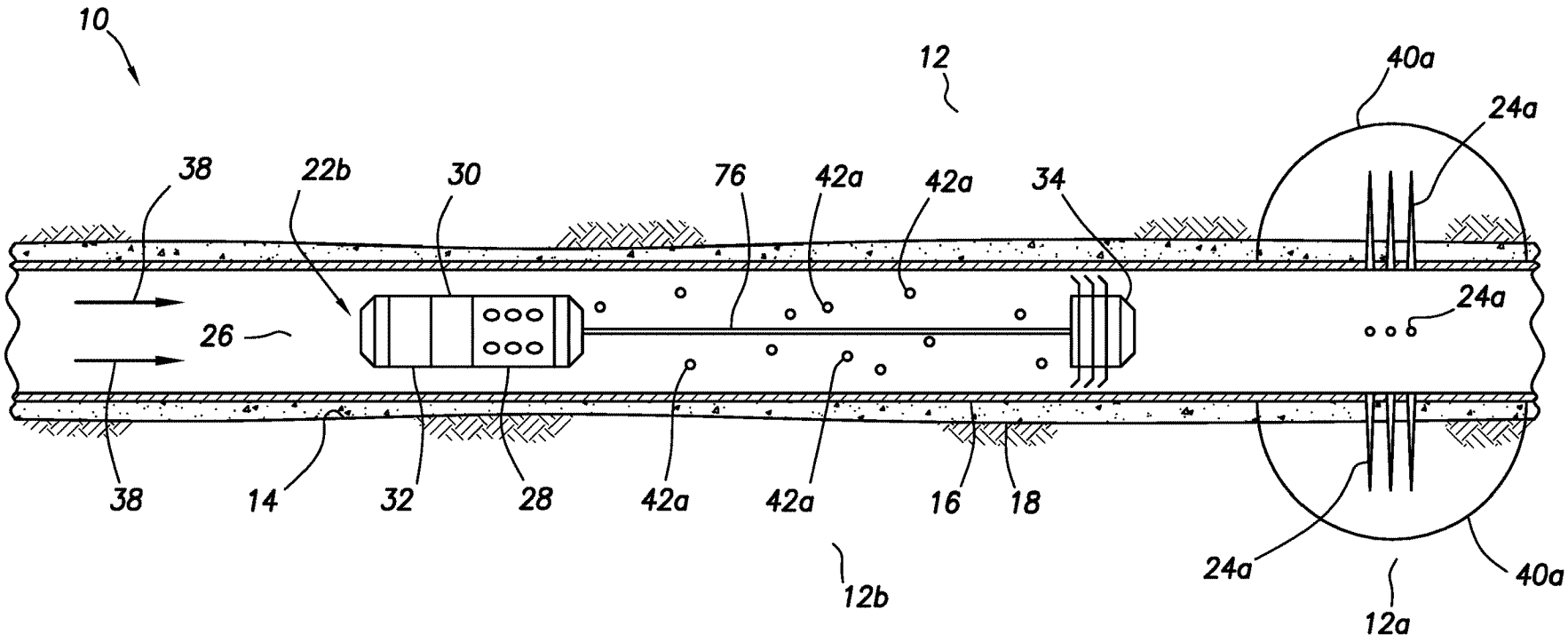
FIGS. 3A & B are representative partially cross-sectional views of successive steps in another example of the well completion system and associated method.

Referring additionally now to FIGS. 3A & B, another example of the system 10 and method are representatively illustrated. In this example, the diverter(s) 42*a* are conveyed or displaced through the flow passage 26 with the perforating assembly 22*b* after or during the forming of the fractures 40*a* in the zone 12*a*.

Note that the flow restrictor 34 in the FIGS. 3A & B example is spaced apart from the remainder of the perforating assembly 22*b* as the perforating assembly displaces through the flow passage 26. However, the flow restrictor 34 is connected to the perforator 28, firing head 30 and control module 32 by a tether 76, so that the perforator is positioned a known distance from the flow restrictor 34.

As depicted in FIG. 3A, a portion of the flow passage 26 is, thus, defined between the flow restrictor 34 and the remainder of the perforating assembly 22*b*. The diverter(s) 42*a* are positioned in this portion of the flow passage 26 as the perforating assembly 22*b* displaces through the flow passage.

Figure 3B:
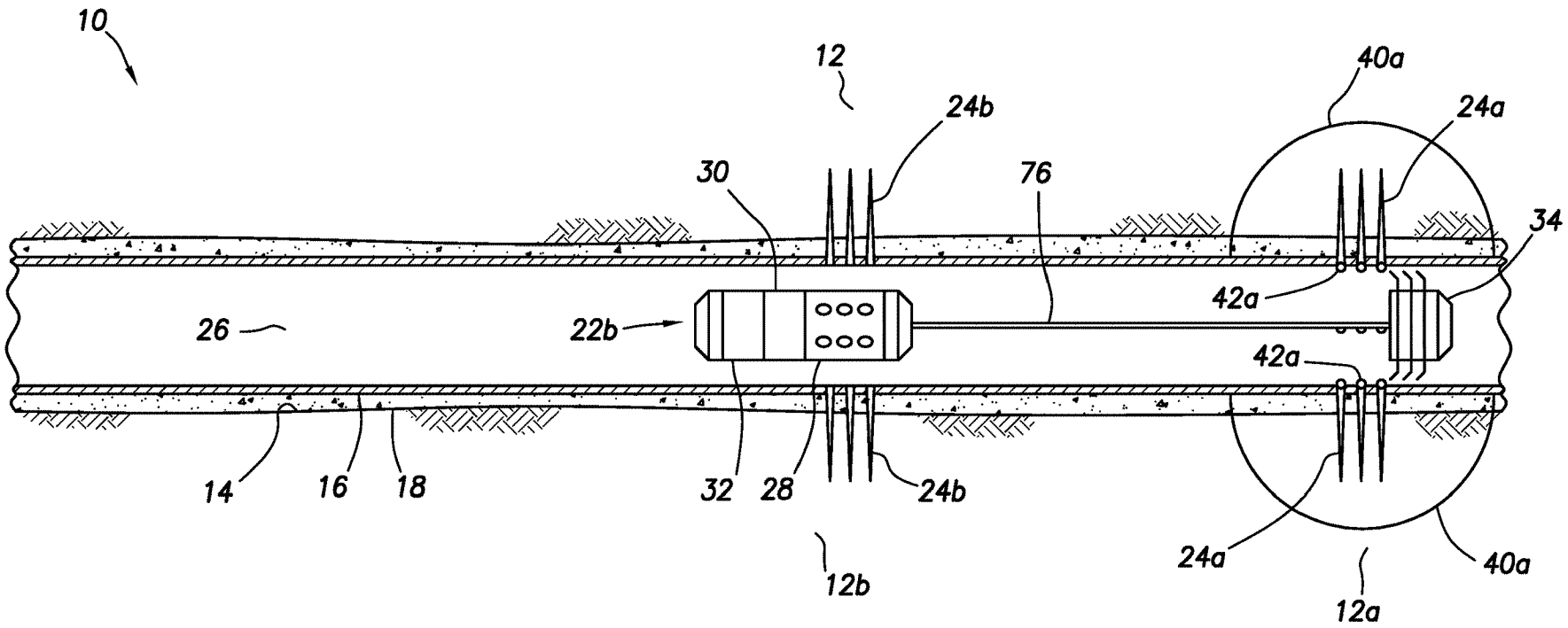

As depicted in FIG. 3B, when the flow restrictor 34 passes open perforations 24*a*, the perforating assembly 22*b* will cease displacing through the flow passage 26, since the fluid 38 will flow outward into the zone 12*a* via the open perforations 24*a*. The diverter(s) 42*a* can engage the perforations 24*a* or enter the perforations to thereby prevent flow through the perforations into the zone 12*a*. At this point (the flow restrictor 34 having passed the open perforations 24*a*), the perforator 28 is appropriately positioned in the desired location for forming the perforations 24*b*.

Flow of the fluid 38 can be ceased, to ensure that the perforating assembly 22*b* remains motionless, and the perforator 28 will eventually fire (e.g., after a certain period of time, and at or above a certain minimum pressure level and temperature level, as described above). In some examples, the perforator 28 may form the perforations 24*b* as soon as the control module 32 determines that the perforator is at the desired location for forming the perforations, whether or not the perforating assembly 22*b* is motionless, or in response to a signal transmitted from the surface.

A decreased pressure and/or increased flow rate may be detected by an operator at surface as an indication that the flow restrictor 34 has passed the open perforations 24*a*. Then, the operator may detect an increased pressure and/or decreased flow rate when the diverter(s) 42*a* prevent flow into the zone 12*a*. These or other indications may be used by the operator to confirm the operation's progress and to determine when flow of the fluid 38 should be ceased, so that the perforator 28 is positioned at the desired location for forming the perforations 24*b*.

The configuration of the perforating assembly 22*b* and diverter(s) 42*a* in FIGS. 3A & B may be used in any portion of any of the system 10 and method examples described herein. For example, the FIGS. 3A & B configuration could be used for the perforating assembly 22*c* and diverter(s) 42*b* (see FIG. 1C).

Figure 4:
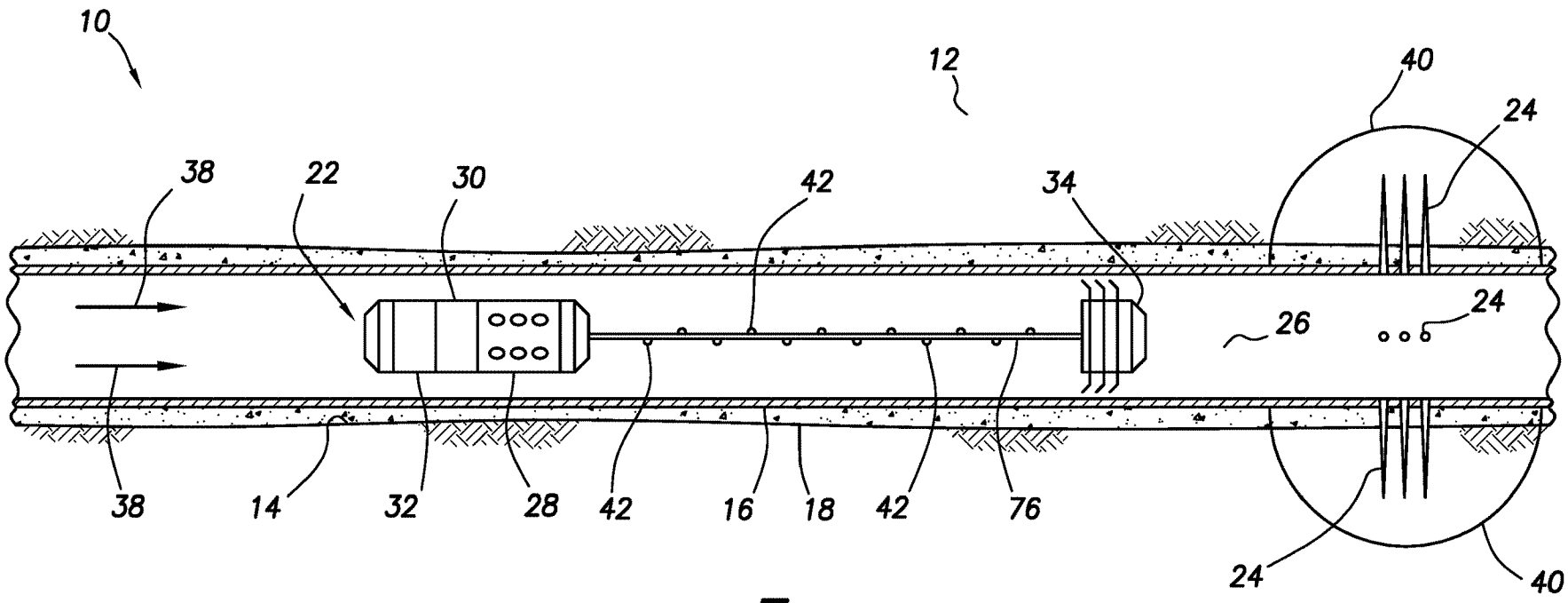
FIG. 4 is a representative partially cross-sectional view of another example of the well completion system and associated method.

Referring additionally now to FIG. 4, another example of the system 10 and method is representatively illustrated. An example of the perforating assembly 22 depicted in FIG. 4 may be used with any of the system 10 and method examples described herein.

In the FIG. 4 example, the diverter(s) 42 are releasably attached to the tether 76, at least initially when the perforating assembly 22 is deployed into the well. For example, the diverter(s) 42 could be adhered, bonded or otherwise secured to the tether 76 using a dissolvable material (such as PLA, PGA or PVA) so that, after deployment into the well, the diverters are released into the portion of the flow passage 26 between the flow restrictor 34 and the remainder of the perforating assembly 22. In another example, the diverters 42 could be released from the tether 76 in response to firing of the perforator 28 (e.g., due to a mechanical or pressure shock wave caused by the firing), in which case the diverters can engage or otherwise prevent flow through the perforations 24 after the perforator has been fired.

Figure 5:
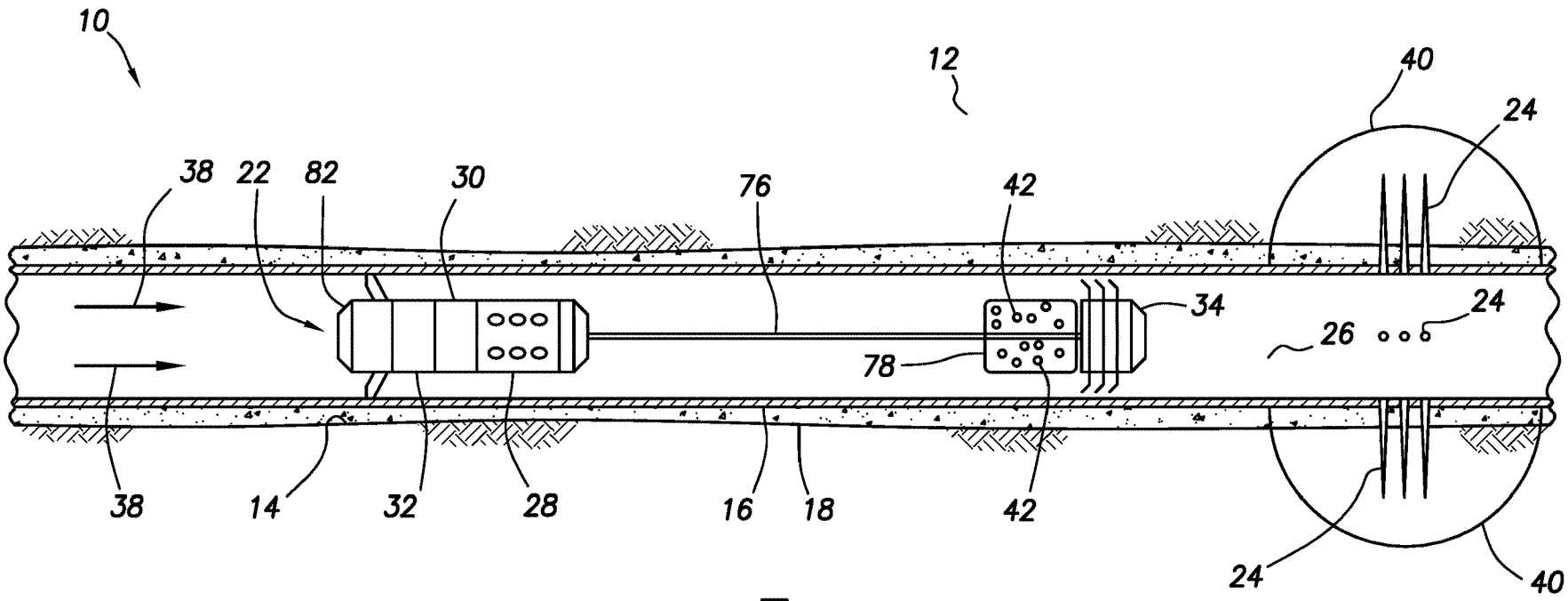
FIG. 5 is a representative partially cross-sectional view of another example of the well completion system and associated method.

Referring additionally now to FIG. 5, another example of the system 10 and method is representatively illustrated. An example of the perforating assembly 22 depicted in FIG. 5 may be used with any of the system 10 and method examples described herein.

In the FIG. 5 example, the diverter(s) 42 are contained in a container 78, which may be attached or secured to the flow restrictor 34 and/or the tether 76. The container 78 may be in the form of a flexible bag or sack, or the container may be made of a rigid material.

As depicted in FIG. 5, the container 78 is positioned adjacent the flow restrictor 34. In other examples, the container 78 may be positioned adjacent the perforator 28 or between the flow restrictor 34 and the remainder of the perforating assembly 22 (such as, midway between the flow restrictor and the perforator).

The container 78 may be dissolvable, melt-able or otherwise degradable downhole to thereby release the diverters 42 into the portion of the flow passage 26 between the flow restrictor 34 and the remainder of the perforating assembly 22 after deployment into the well. In some examples, the container 78 may be designed to release the diverters 42 in response to firing of the perforator 28 (e.g., due to a mechanical or pressure shock wave caused by the firing), in which case the diverters can engage or otherwise prevent flow through the perforations 24 after the perforator has been fired.

Figure 6A:
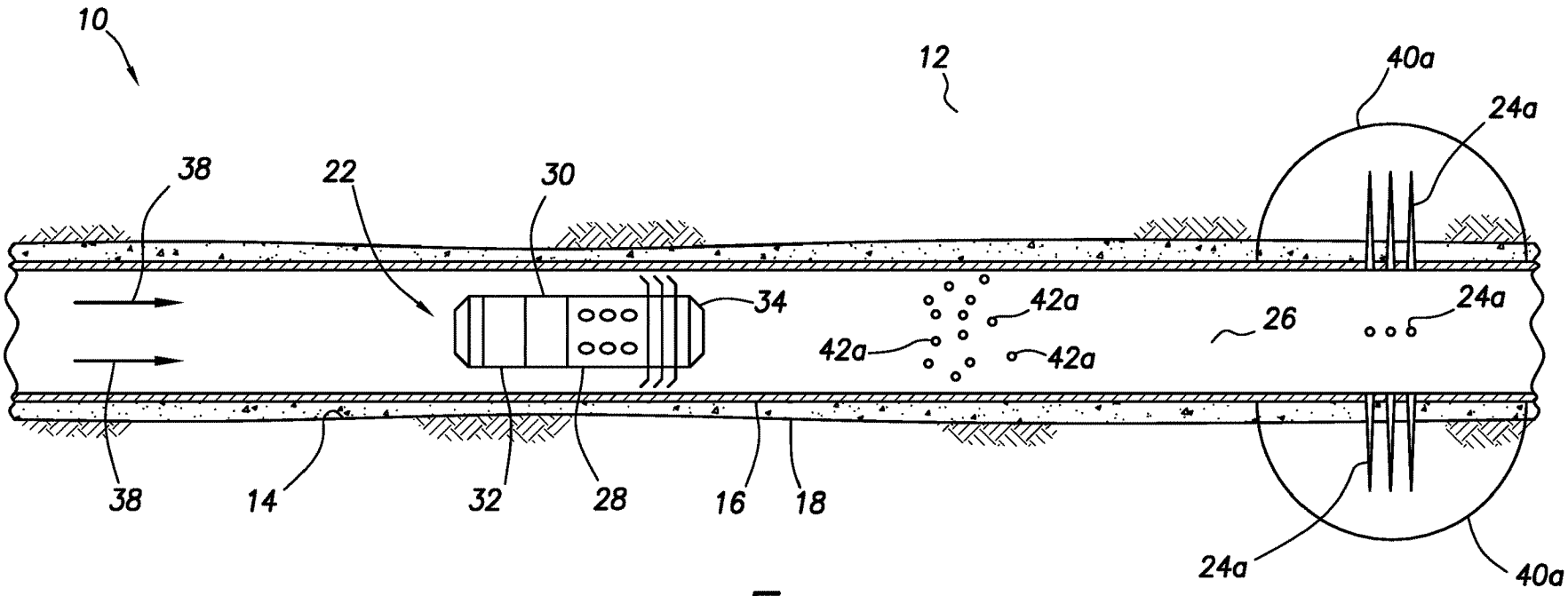
FIGS. 6A & B are representative partially cross-sectional views of successive steps in another example of the well completion system and associated method.

Referring additionally now to FIGS. 6A & B, another example of the system 10 and method is representatively illustrated. Any of the perforating assembly examples described herein may be used with the FIGS. 6A & B system 10 and method.

In the FIGS. 6A & B example, the diverter(s) 42*a* are deployed into the flow passage 26 before, downhole of, or "ahead of" the perforating assembly 22. As depicted in FIG. 6A, the perforating assembly 22 and the diverter(s) 42*a* are displaced together through the flow passage 26 by the flow of the fluid 38.

Figure 6B:
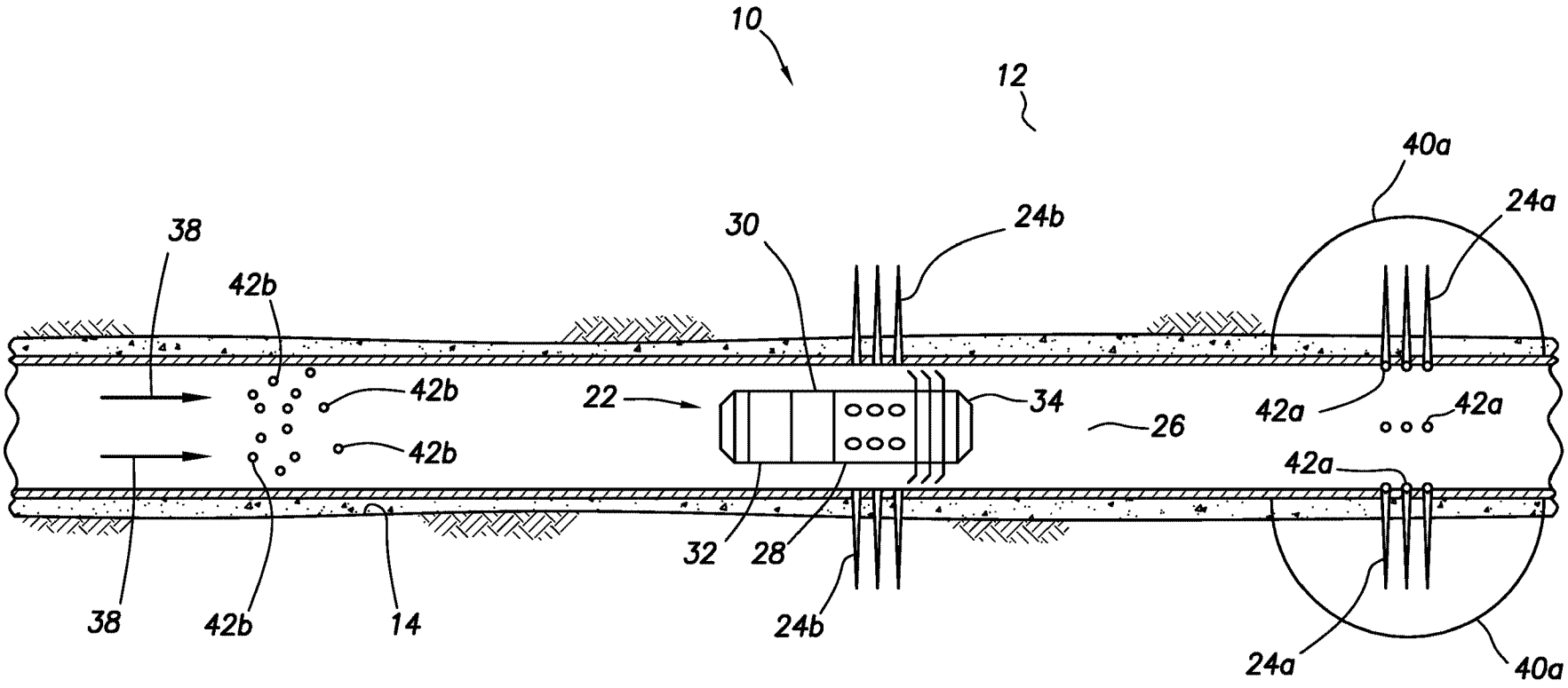

As depicted in FIG. 6B, eventually the diverter(s) 42*a* engage the perforations 24*a* or otherwise prevent flow through the perforations 24*a*. At or after this point, the flow of the fluid 38 is ceased, so that the perforator 28 is positioned at the desired location for forming the perforations 24*b*.

Additional diverter(s) 42*b* may be deployed into the flow passage 26 for displacement with the perforating assembly 22 by the flow of the fluid 38. The diverter(s) 42*b* can engage the perforations 24*b* or otherwise prevent flow out of the perforations after the perforator 28 has been fired.

Figure 7A:
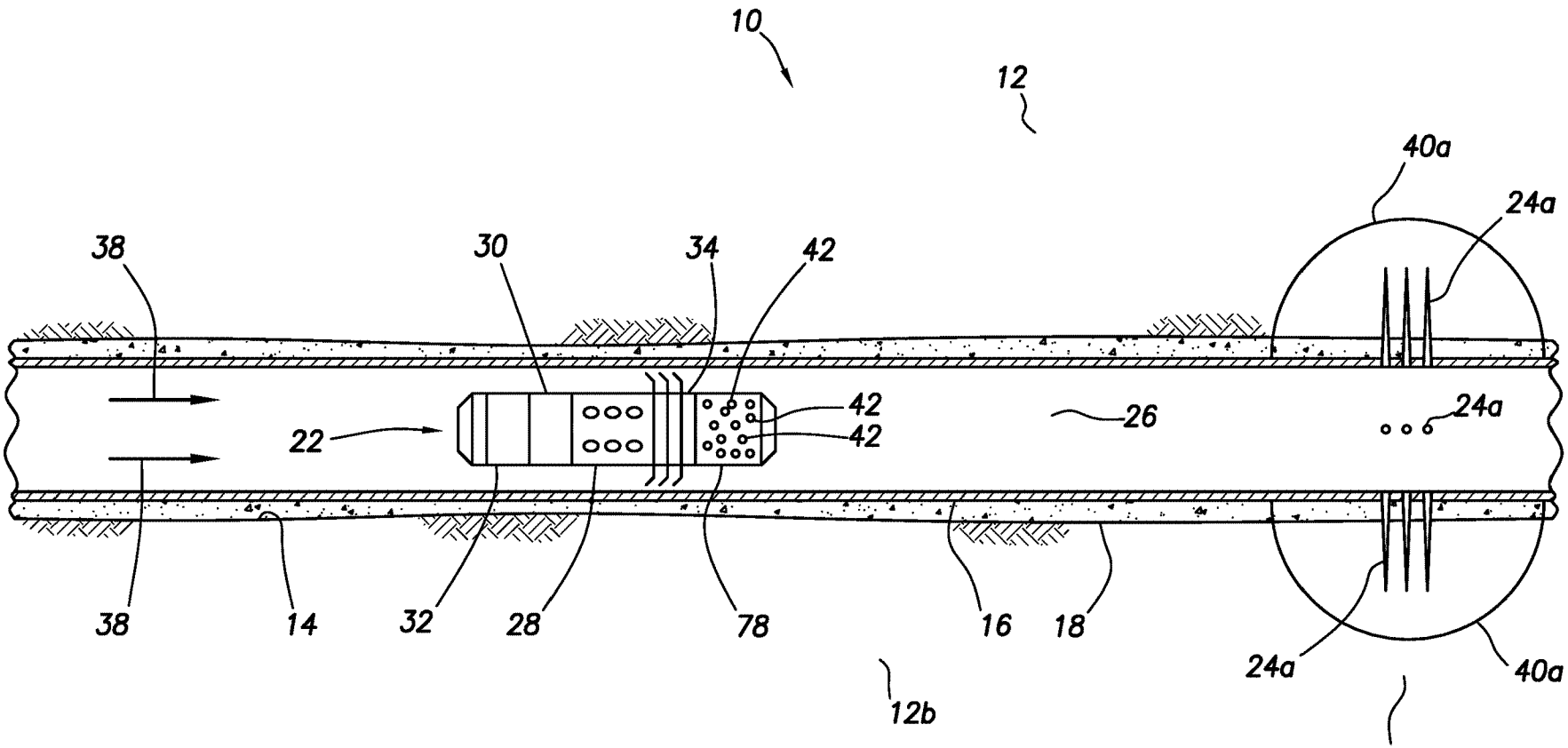
FIGS. 7A & B are representative partially cross-sectional views of successive steps in another example of the well completion system and associated method.

Referring additionally now to FIGS. 7A & B, another example of the system 10 and method is representatively illustrated. In this example, the diverter(s) 42 are contained in the container 78, which is part of the perforating assembly 22, or which is attached or secured to the perforating assembly. Any of the perforating assembly examples described herein may be used with the FIGS. 7A & B system 10 and method.

As depicted in FIG. 7A, the diverter(s) 42 are displaced or conveyed with the perforating assembly 22 by the flow of the fluid 38 through the flow passage 26. The container 78 may be dissolvable, melt-able or otherwise degradable downhole to thereby release the diverters 42 into the flow passage 26 downhole of, or "ahead of," the perforating assembly 22 after deployment into the well.

Figure 7B:
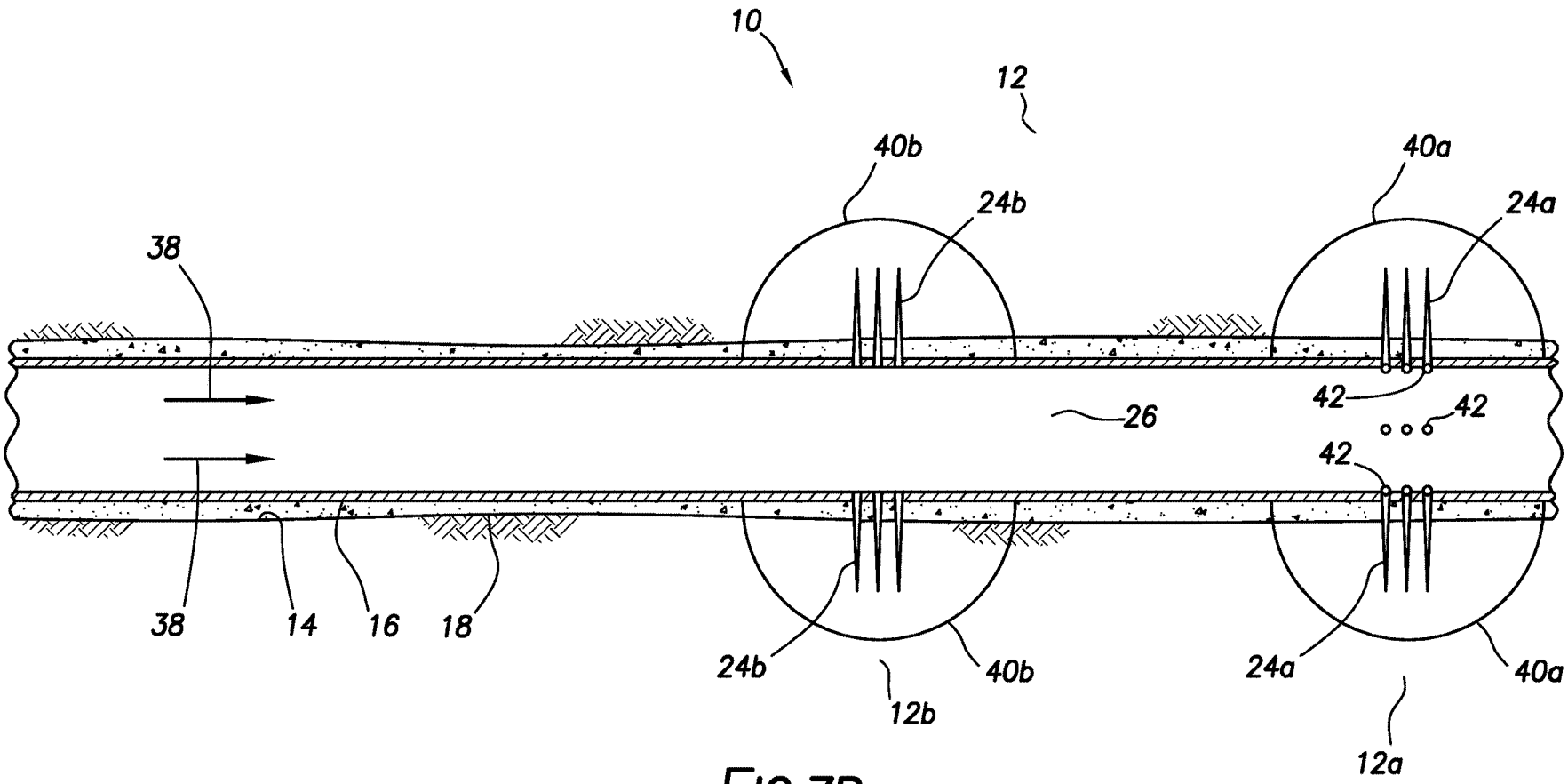

As depicted in FIG. 7B, the perforator assembly 22 and the container 78 have dissolved, disintegrated or otherwise degraded, preferably before firing of the perforator 28, so that the diverter(s) 42 prevent flow into the perforations 24*a*, and fracturing fluid 38 can flow through the perforations 24*b* and into the zone 12*b* to form the fractures 40*b* after the perforator 28 is fired. In some examples, the container 78 may be designed to release the diverters 42 in response to firing of the perforator 28 (e.g., due to a mechanical or pressure shock wave caused by the firing), in which case the diverters can engage or otherwise prevent flow through the perforations 24*a* after the perforator has been fired.

Figure 8:
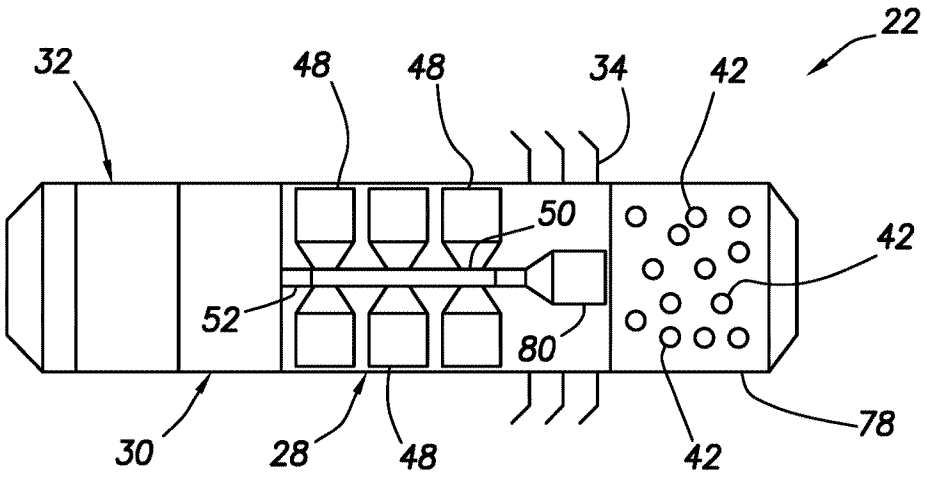
FIGS. 8-13 are representative partially cross-sectional views of additional examples of the perforating assembly.

Referring additionally now to FIG. 8, another example of the perforating assembly 22 is representatively illustrated. The FIG. 8 perforating assembly 22 may be used with any of the system 10 and method examples described herein.

In the FIG. 8 example, the container 78, with the diverter(s) 42 therein is secured to the perforating assembly 22 (similar to the FIG. 7A example). However, the perforator 28 includes an additional shaped charge 80 or other explosive device (or a propellant and bullet, etc.) that is directed toward the container 78.

When the perforator 28 is fired, the shaped charge or other device 80 pierces, opens, breaks, fractures, disperses or otherwise causes the diverter(s) 42 to be released from the container 78. In this example, the container 78 may be made of a friable or frangible material and/or may be configured to conveniently break open in response to firing of the device 80.

Figure 9:
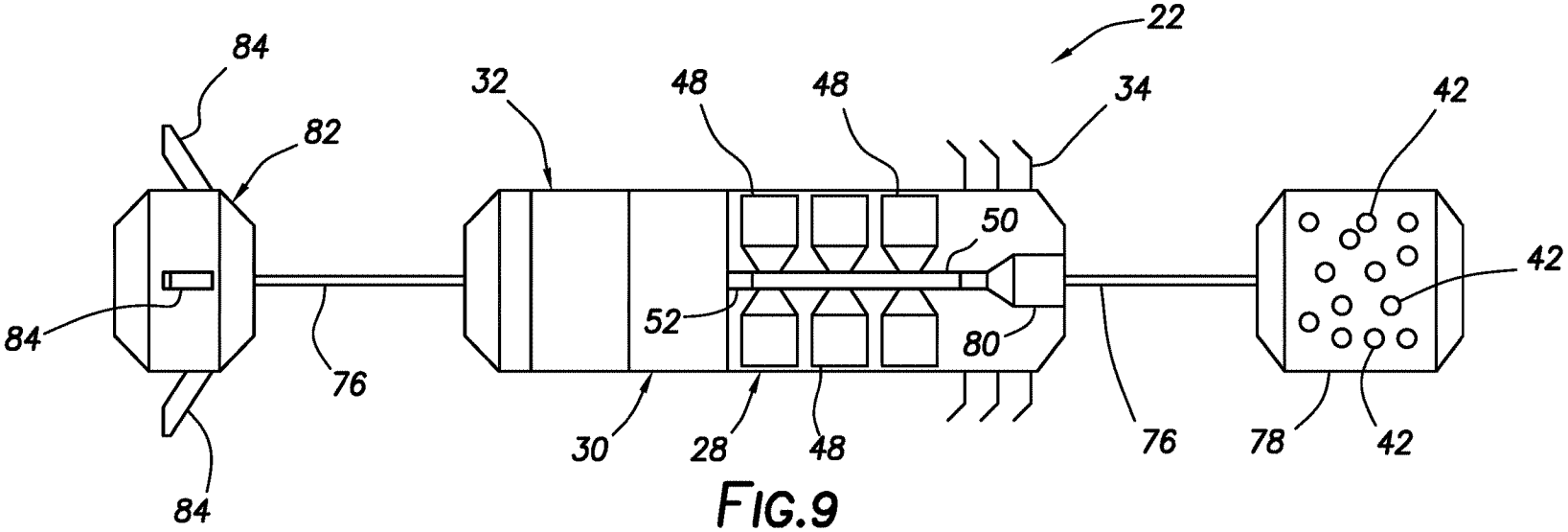

Referring additionally now to FIG. 9, another example of the perforating assembly 22 is representatively illustrated. The FIG. 9 perforating assembly 22 may be used with any of the system 10 and method examples described herein.

In the FIG. 9 example, the container 78, with the diverter(s) 42 therein is secured to the perforating assembly 22 via the tether 76. When the perforator 28 is fired, the shaped charge or other device 80 pierces, opens, breaks, fractures, disperses or otherwise causes the diverter(s) 42 to be released from the container 78, which may be made of a friable or frangible material and/or may be configured to conveniently break open in response to firing of the device 80.

Alternatively, the firing of the device 80 could release or break the tether 76, thereby allowing the container 78 with the diverter(s) 42 therein to separate from the remainder of the perforating assembly 22. The diverter(s) 42 could be released from the container 78 in response to dissolution, corrosion, dispersal, melting, breaking or other degrading of the container.

In the FIG. 9 example, the perforating assembly 22 also includes a drag device 82 connected to the remainder of the perforating assembly by another tether 76. As depicted in FIG. 9, the drag device 82 includes pads or arms 84 that extend outward to resiliently engage an interior surface of the casing 16. In some examples, the drag device 82 could be similar to drag blocks of the type used with mechanically-set packers.

Friction between the drag device arms 84 and the interior surface of the casing 16 imparts a drag force via the tether 76 to the remainder of the perforating assembly 22, thereby ensuring that the perforator 28 will remain "behind" or uphole of the diverter(s) 42 and container 78, as the perforating assembly 22 is displaced through the flow passage 26 by the flow of the fluid 38. In this manner, the diverter(s) 42 will continue downhole to previously formed perforations, rather than engage perforations formed by the perforator 28 to which the container 78 is attached.

Note that the drag device 82 may be used with any of the perforating assemblies 22 and methods described herein, in which the diverter(s) 42, 42*a-c* are conveyed through the flow passage 26 concurrently with a perforating assembly (for example, see FIG. 5).

Referring additionally now to FIGS. 10-13, additional examples of the perforating assembly 22 are representatively illustrated. These examples of the perforating assembly 22 may be used with any of the system 10 and method examples described herein.

In the FIGS. 10-13 examples, the diverter(s) 42 are secured on an exterior of the perforating assembly 22. The diverter(s) 42 may be released from the exterior of the perforating assembly 22 examples of FIGS. 10-13 using any suitable technique. For example, the diverter(s) 42 could be adhered or bonded to the exterior of the perforating assembly 22 using a substance that dissolves, melts, corrodes or otherwise degrades in the well environment, so that the diverter(s) are released from the perforating assembly downhole after deployment of the perforating assembly into the well.

In other examples, the diverter(s) 42 could be attached to the exterior of the perforating assembly 22 using frangible or friable fasteners, clamps or other attachment devices that break in response to shock produced when the perforator 28 is fired. The scope of this disclosure is not limited to any particular technique for releasing the diverter(s) 42 from the exterior of the perforating assembly 22 downhole.

Figure 10:
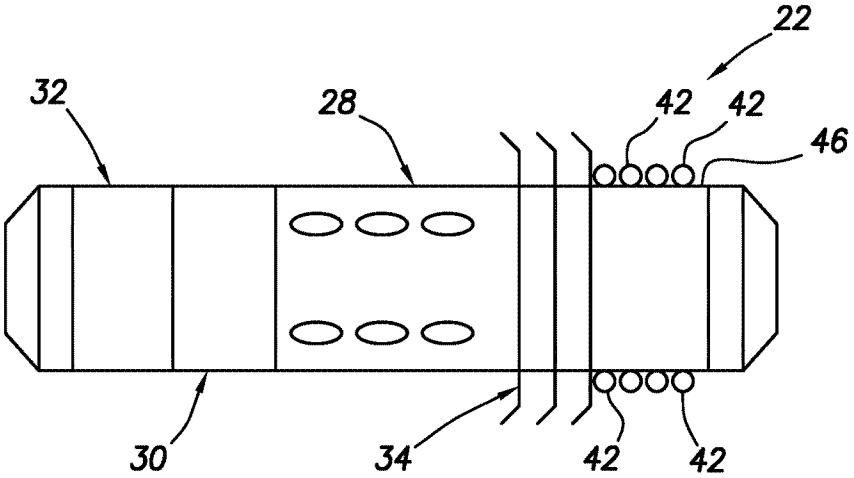

As depicted in FIG. 10, the diverter(s) 42 are attached, fastened, clamped, adhered, bonded or otherwise secured to an exterior of the outer housing 46.

The diverter(s) 42 may be released from the perforating assembly 22 after the perforating assembly is introduced into the well (e.g., due to contact with an activating fluid or elevated temperature in the well), or in response to firing of the perforator 28.

Figure 11:
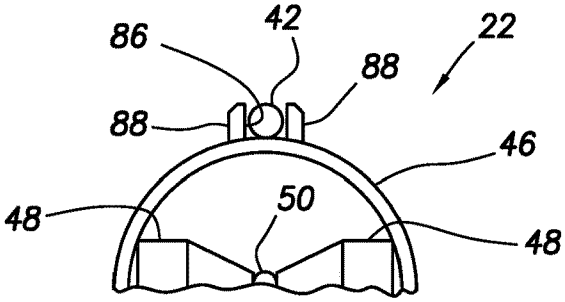

As depicted in FIG. 11, the diverter(s) 42 are attached, fastened, clamped, adhered, bonded or otherwise secured in a groove, channel or recess 86 on the perforating assembly 22. In this example, the recess 86 is formed between rails 88 secured on the outer housing 46, but in other examples the recess (or multiple recesses) could be formed directly in the outer housing, or otherwise arranged on the perforating assembly 22. The diverter(s) 42 may be released from the perforating assembly 22 after the perforating assembly is introduced into the well (e.g., due to contact with an activating fluid or elevated temperature in the well), or in response to firing of the perforator 28.

Figure 12:
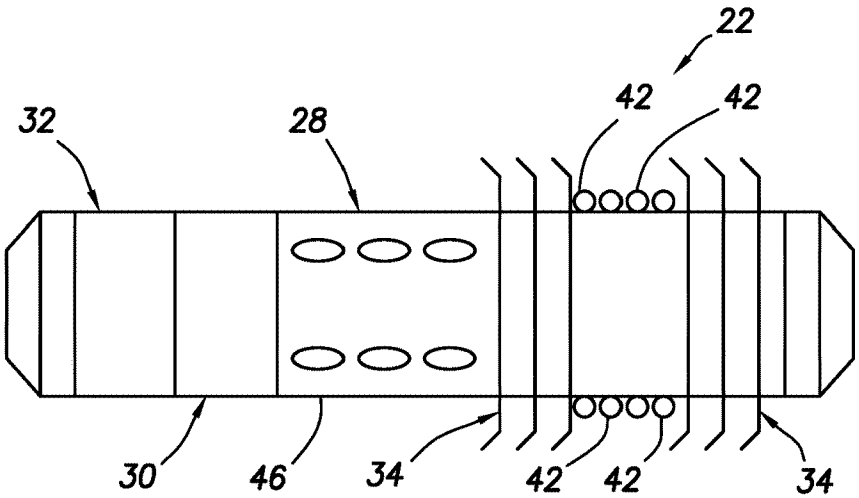

As depicted in FIG. 12, the diverter(s) 42 are attached, fastened, clamped, adhered, bonded or otherwise secured between multiple flow restrictors 34 on the perforating assembly 22. The diverter(s) 42 may be released from the perforating assembly 22 after the perforating assembly is introduced into the well (e.g., due to contact with an activating fluid or elevated temperature in the well), or in response to firing of the perforator 28.

In other examples, the diverter(s) 42 may be contained between the flow restrictors 34, without being attached, bonded, etc., to the outer housing 46. For example, the "lower" (further downhole) flow restrictor 34 could dissolve or otherwise degrade downhole (for example, in response to contact with an activating fluid in the well) to release the diverter(s) 42 from the perforating assembly 22.

Figure 13:
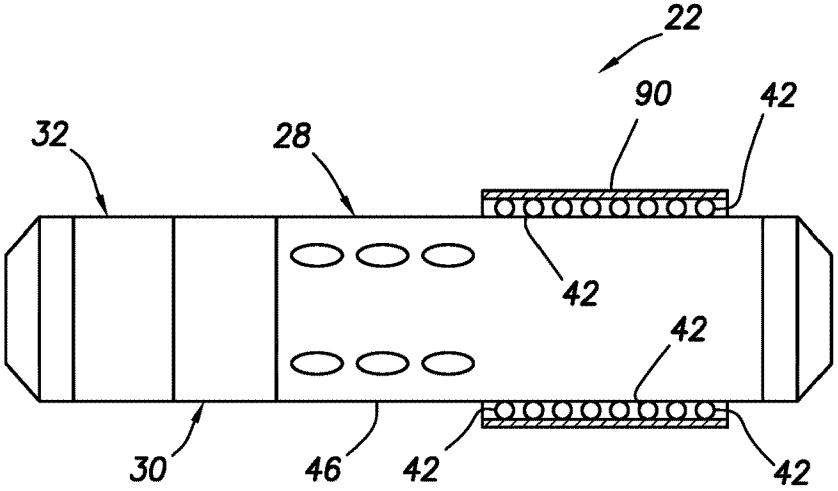

As depicted in FIG. 13, the diverter(s) 42 are retained on the exterior of the perforating assembly 22 by a degradable sleeve 90. For example, the sleeve 90 could be made of a material that is capable of "shrinking" onto the perforating assembly 22, so that the diverter(s) 42 are captured between the sleeve and the outer housing 46. The sleeve 90 could dissolve, melt or otherwise degrade downhole (e.g., in response to contact with an activating fluid or elevated temperature in the well), or the sleeve could disperse or break in response to firing of the perforator 28.

Note that a separate flow restrictor 34 is not depicted for the FIG. 13 example. The perforating assembly 22 in this example could be used without a separate flow restrictor, or the sleeve 90 could serve as the flow restrictor, at least until it degrades to release the diverter(s) 42 (at which point the perforating assembly may be disposed in a smaller diameter casing, so that the flow restrictor 34 is not needed).

Figure 14:
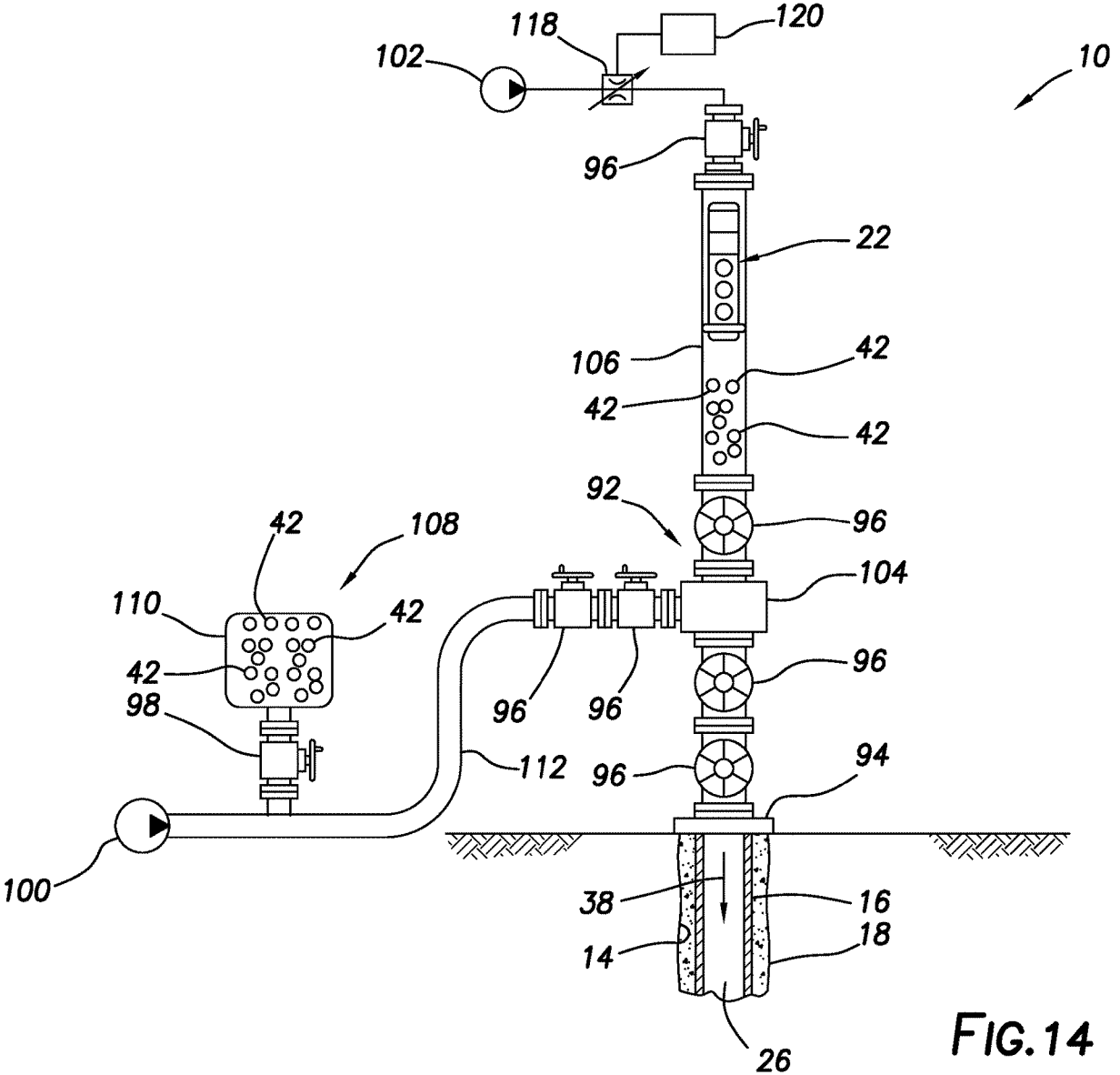
FIG. 14 is a representative partially cross-sectional view of another example of the well completion system and associated method.

Referring additionally now to FIG. 14, an example surface installation 92 for practice of the system 10 and method is representatively illustrated. The surface installation 92 is depicted as being attached to a wellhead 94 from which the casing 16 is hung.

However, as will be appreciated by those skilled in the art, multiple casing strings are typically hung from a wellhead facility, so it should be understood that the single casing 16 is depicted in FIG. 14 merely for clarity of illustration and description. In addition, it is not necessary for the casing 16 in which perforations 24 are formed in the method to be hung from a surface wellhead facility. Thus, the scope of this disclosure is not limited at all to the details of the surface installation 92 as depicted in FIG. 14.

In the FIG. 14 example, a variety of valves 96 are connected between the wellhead 94 and pumps 100, 102 for pumping fluid 38 into the flow passage 26. The valves 96, pumps 100, 102 and a flow head 104 may be of the types typically used in well fracturing operations.

The perforating assembly 22 may be contained in a tubular housing 106 connected above the flow head 104. The housing 106 and associated connections, valves, etc., may be of the type commonly referred to by those skilled in the art as a "lubricator," although other types of housings may be used if desired.

The perforating assembly 22 may be deployed into the flow passage 26 by opening the valves 96 between the pump 102 and the wellhead 94, and operating the pump 102 to flow the fluid 38 into the well. Any of the perforating assemblies 22, 22*a-c* described herein may be deployed using this technique.

If it is desired to deploy diverter(s) 42 with the perforating assembly 22, the diverter(s) may also be contained in the housing 106 with the perforating assembly. Diverter(s) 42 may be positioned above and/or below the perforating assembly 22 in the housing 106.

Diverter(s) 42 may be separately deployed into the well by use of a dispenser 108, for example, connected to the flow head 104. The dispenser 108 may comprise a container 110 for containing the diverter(s) 42 and a valve 98 for selectively permitting the diverter(s) to enter a flow line 112 connected between the pump 100 and the flow head 104. Alternatively, any of the dispensers described in the US patents and applications listed above may be used for the dispenser 108.

The diverter(s) 42 may be deployed into the well by opening the valve 98 and the valves 96 between the pump 100 and the flow head 104, and between the flow head and the wellhead 94, and operating the pump 100 to flow the fluid 38 into the well. The diverter(s) 42 may be deployed from the dispenser 108 before and/or after a perforating assembly 22 is deployed.

It is contemplated that the perforating assembly 22 and the diverters 42 will not necessarily displace through the flow passage 26 with the fluid 38 at a same speed for a given flow rate. This difference in speeds may be used to achieve a desired spacing between the perforating assembly 22 and the diverters 42 in the well (for example, so that the diverters 42 engage previously formed perforations 24 when, or just after, the perforating assembly 22 arrives at a desired location for forming new perforations).

In a simplified example, the following equation may be used to determine a spacing between the diverters 42 and the perforating assembly 22: $S=(S_D-S_{PA})\times T$, in which S is the spacing, $S_D$ is the speed of the diverters 42 at a given fluid 38 flow rate, $S_{PA}$ is the speed of the perforating assembly 22 at the given flow rate, and T is the elapsed time. The diverters 42 and perforating assembly 22 may also, or alternatively, be released into the flow passage 26 at different times, in order to achieve a desired spacing between them.

In the FIG. 14 example, a variable flow restrictor 118 is connected between the pump 102 and the surface installation 92. The variable flow restrictor 118 can be used to produce pressure fluctuations or "pulses" in the flow of the fluid 38 into the well. These pressure pulses can be produced with predetermined patterns, frequencies, amplitudes, spacings, etc., and thereby used to transmit data or instructions to the control module 32 of the perforating assembly 22 while the fluid 38 is being flowed into the well.

For example, the pressure pulses can be detected by the pressure sensor 68 of the control module 32 (e.g., see FIG. 2) and decoded using the controller 62. In this manner, the control module 32 can be instructed to fire the perforator 28 (e.g., by closing the switch 56) when the perforator is positioned at a desired location for forming perforations 24.

A telemetry control system 120 at the surface installation 92 can be used to control operation of the variable flow restrictor 118. For example, the control system 120 can actuate the variable flow restrictor 118 to send appropriate pressure pulses to the perforating assembly 22 downhole to cause the perforator 28 to fire when a predetermined volume of the fluid 38 has been flowed into the flow passage 26 (such as, a sufficient volume to position the perforator at the desired location for forming the perforations 24), e.g., as determined by a flow meter (not shown) connected to the control system 120. As another example, the control system 120 could actuate the variable flow restrictor 118 to send appropriate pressure pulses to the perforating assembly 22 downhole to cause the perforating assembly to self-destruct (e.g., as described above in relation to the FIG. 2 example).

Note, however, that the scope of this disclosure is not limited to use of any particular form of telemetry for communicating between the surface installation 92 and the perforating assembly 22 downhole. In some examples, the variable flow restrictor 118 could instead be an acoustic telemetry transmitter, and the control module 32 could include an appropriate acoustic telemetry receiver, for communicating between the surface installation 92 and the perforating assembly 22 downhole. The scope of this disclosure is also not limited to use of telemetry between the surface installation 92 and the perforating assembly 22 downhole for any particular purpose.

Figure 15:
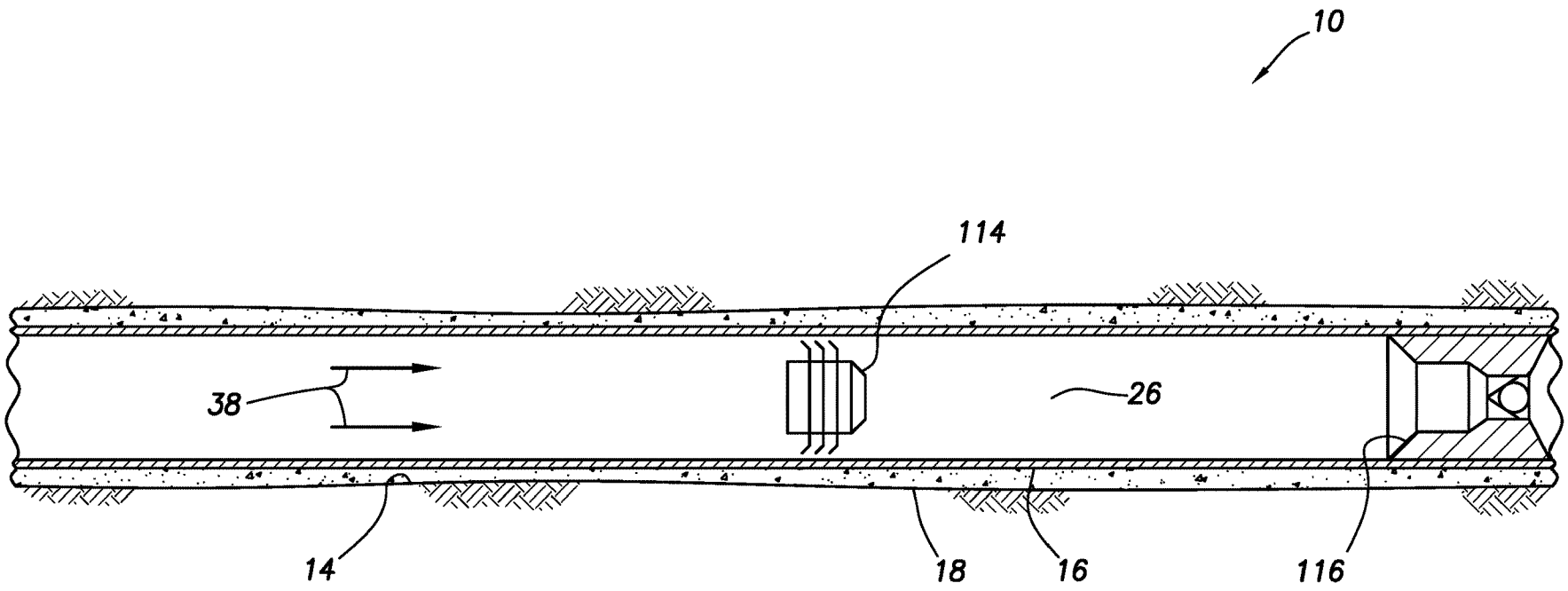
FIG. 15 is a representative partially cross-sectional view of another example of the well completion system and associated method.

Referring additionally now to FIG. 15, an example of a calibration method that may be used with the system 10 is representatively illustrated. The FIG. 15 method may be used to determine the volume of fluid 38 that should be flowed through the flow passage 26, in order to position a perforating assembly 22 at a desired location for forming perforations 24 (see, e.g., FIG. 4).

In the FIG. 15 method, a plug or "pig" 114 is introduced into the flow passage 26, and then the fluid 38 is pumped into the flow passage behind the pig, in order to displace the pig through the flow passage, similar to the manner described above for the perforating assembly 22. The volume of the fluid 38 flowed into the passage 26 is monitored during this process. Note that the fluid 38 used in this calibration method is not necessarily the same as the fluid used to convey the perforating assembly 22 or diverters 42 through the passage 26, or the same fluid used to form the fractures 40.

Eventually, the pig 114 will engage a restriction 116 positioned at a known distance along the flow passage 26. An operator at surface will note a pressure increase and/or a flow rate decrease as an indication that the pig 114 has engaged the restriction 116.

In the FIG. 15 example, the restriction 116 comprises a cementing shoe connected proximate a distal end of the casing 16. However, other types of restrictions (such as liner hangers, bridge plugs, etc.) may be used in other examples.

Since the restriction 116 is at a known distance along the flow passage 26, and the volume of the fluid 38 required to displace the pig 114 to the restriction is measured in the FIG. 15 method, a determination can be conveniently made as to what volume of fluid is required to displace the perforating assembly 22 through the flow passage to a desired location.

In a simplified example, the following equation may be used: $V_{PA}=V_{PR}\times(D_{PA}/D_{PR})$, in which $V_{PA}$ is the volume to displace the perforating assembly 22 to the desired location, $V_{PR}$ is the volume to displace the pig 114 to the restriction 116, $D_{PA}$ is the distance to the desired location of the perforating assembly, and $D_{PR}$ is the distance to the restriction.

The above equation results from assumptions, including that the flow passage 26 has a consistent cross-sectional area to the restriction 116, and that the perforating assembly 22 and the pig 114 displace the same in response to the flow of the fluid 38. In some circumstances (for example, long horizontal wellbores with long productive intervals), inaccuracies due to these assumptions may be acceptable. To reduce the inaccuracies, differences in the flow passage 26 cross-sectional area can be accounted for, and the pig 114 can be configured to displace the same as the perforating assembly 22 in response to the fluid flow (or the differences between the displacements of the pig and the perforating assembly could be empirically determined and accounted for).

Figure 16A:
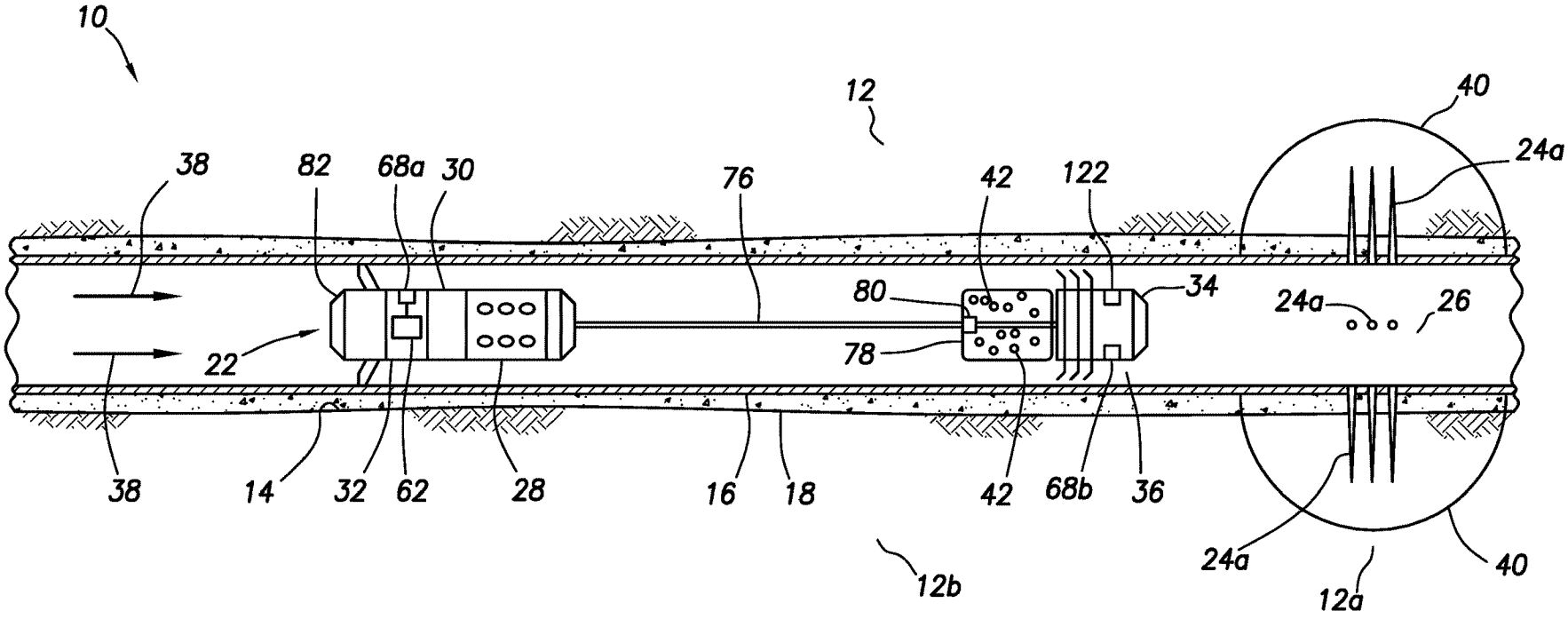
FIGS. 16A & B are representative partially cross-sectional views of successive steps in another example of the well completion system and associated method.

Referring additionally now to FIGS. 16A & B, another example of the perforating assembly 22 is representatively illustrated. The FIGS. 16A & B perforating assembly 22 may be used with any of the system 10 and method examples described herein.

As depicted in FIG. 16A, the perforating assembly 22 is similar in many respects to the perforating assembly example of FIG. 5. However, in the FIG. 16A example, the pressure sensor of the control module 32 is indicated with reference number 68*a* and another pressure sensor 68*b* is included with the flow restrictor 34. Pressure measurements from the pressure sensor 68*b* can be communicated to the controller 62, for example, via the tether 76 (which could include an electrical conductor, a fiber optic line or other signal transmission means).

The use of separate, spaced apart pressure sensors 68*a,b* in the perforating assembly 22 enables detection of a pressure differential between correspondingly spaced apart sections of the flow passage 26. In the FIG. 16A example, the pressure sensor 68*b* detects pressure in the flow passage 26 at the flow restrictor 34 (such as, "below" or downhole of the annulus 36 restriction), whereas the pressure sensor 68*a* detects pressure in the flow passage "above" or uphole of the flow restrictor.

Figure 16B:
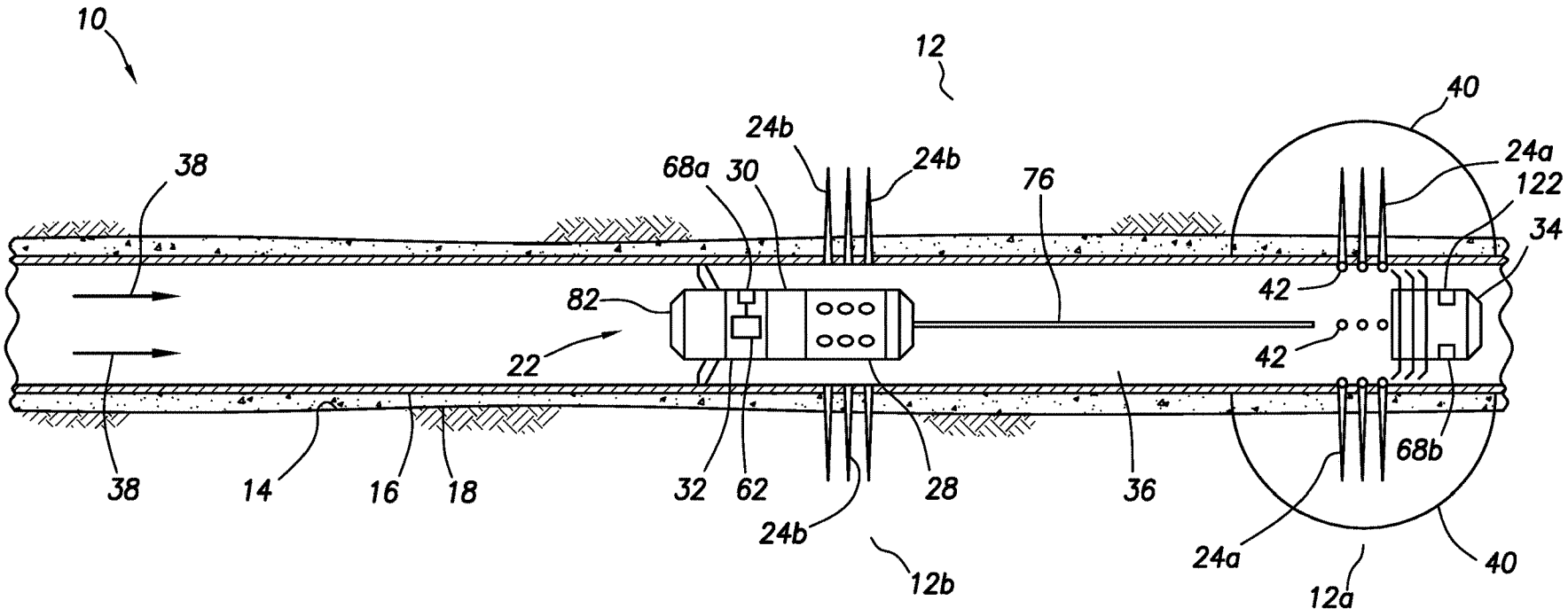

It is contemplated that, as the flow restrictor 34 nears the existing perforations 24*a*, the pressure as detected by the pressure sensor 68*b* will decrease, due to flow of the fluid 38 out of the flow passage 26 via the perforations. A further pressure differential variation will be detected by the pressure sensors 68*a,b* when the flow restrictor 34 passes at least one of the open perforations 24*a*. In response to a predetermined pressure differential condition or pattern of variation (as detected by the pressure sensors 68*a,b*) indicating that the flow restrictor 34 is in a certain position relative to the perforations 24*a* (and, therefore, that the perforator 28 is in a desired location for forming perforations 24*b*), the controller 62 can cause the perforator to fire and form the perforations 24*b* as depicted in FIG. 16B.

As an alternative, or in addition, to use of the pressure sensor 68*b* with the flow restrictor 34, a noise or acoustic sensor 122 could be included in the flow restrictor (or otherwise spaced apart from the perforator 28). The acoustic sensor 122 can communicate with the controller 62, for example, via the tether 76.

It is contemplated that, as the flow restrictor 34 nears the existing perforations 24*a* as depicted in FIG. 16A, acoustic noise as detected by the sensor will increase in amplitude (due, for example, to cavitation in the fluid 38 as it flows outward through the perforations 24*a*). In response to a predetermined acoustic condition or pattern of variation (as detected by the sensor 122) indicating that the flow restrictor 34 is in a certain position relative to the perforations 24*a* (and, therefore, that the perforator 28 is in a desired location for forming perforations 24*b*), the controller 62 can cause the perforator to fire and form the perforations 24*b* as depicted in FIG. 16B.

Note that, in the FIGS. 16A & B example, the explosive device or shaped charge 80 is positioned at or in the container 78. The controller 62 can cause the shaped charge 80 to detonate and thereby release the diverters 42 into the flow passage 26 when the measurements or readings communicated to the controller from the pressure sensors 68*a,b* and/or acoustic sensor 122 indicate that the flow restrictor 34 is approaching the existing perforations 24*a*.

In this manner, the diverters 42 can be desirably released into the flow passage 26 just prior to the perforator 28 being positioned at the desired location for forming the perforations 24*b*. The diverters 42 can, thus, engage and prevent flow through the perforations 24*a* after the zone 12*a* has been fractured, and before the new perforations 24*b* are formed. However, in other examples, the diverters 42 could be released from the container 78 by detonating the shaped charge 80 after or when the perforator 28 is positioned at the desired location for forming the perforations 24*b*.

Alternatively, the diverters 42 could be released from the container 78 in response to firing of the perforator 28. For example, the container 78 could be opened, fractured or dispersed in response to a shock wave or pressure wave caused by the firing of the perforator 28.

Note that the diverters 42 are released into the flow passage 26 "below" or downhole of the perforator 28 and the newly formed perforations 24*b*. In this manner, the fluid flow 38 used to fracture or otherwise treat the zone 12*b* will also carry the diverters 42 to the previously formed perforations 24*a*. The diverters 42 will engage the perforations 24*a* or otherwise prevent flow of the fluid 38 into the zone 12*a* and thereby divert the fluid flow to the newly formed perforations 24*b* and into the zone 12*b*, in order to fracture or otherwise treat the zone 12*b*.

Figure 17A:
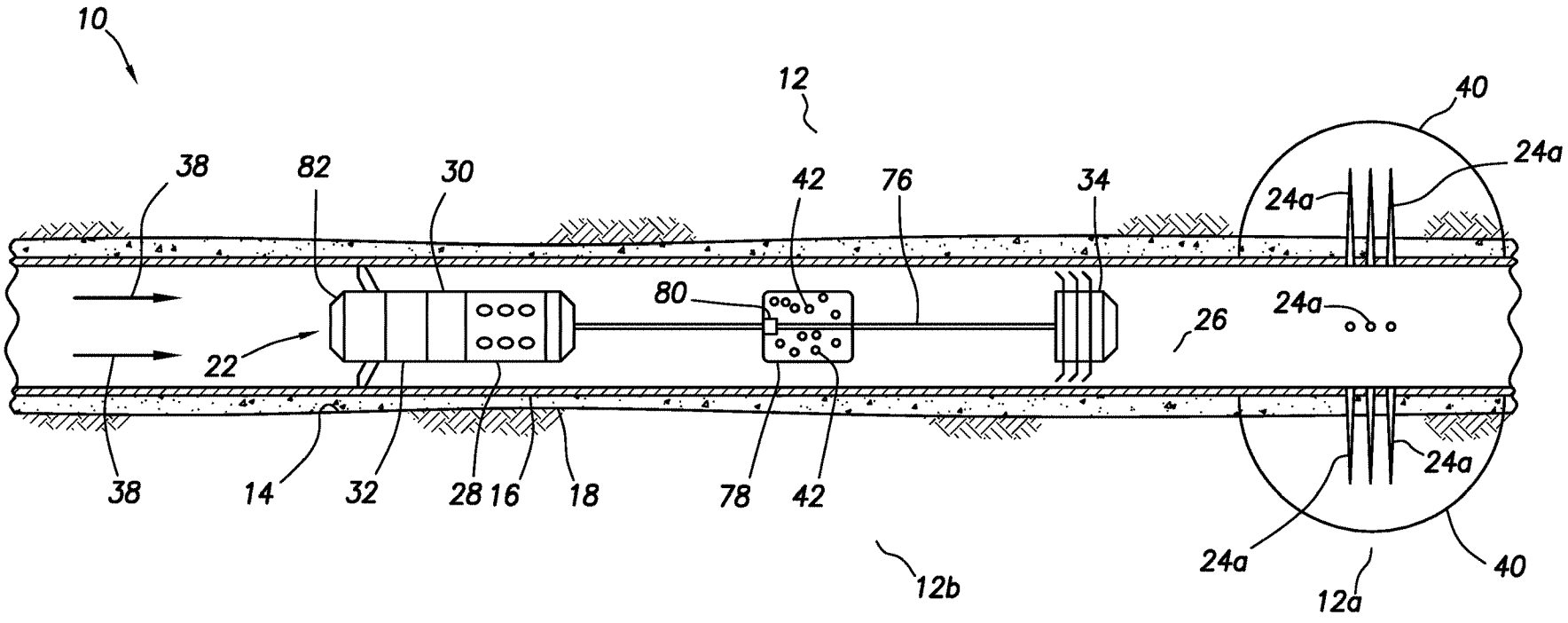
FIGS. 17A & B are representative partially cross-sectional views of successive steps in another example of the well completion system and associated method.

Referring additionally now to FIGS. 17A & B, another example of the perforating assembly 22 is representatively illustrated. The FIGS. 17A & B perforating assembly 22 may be used with any of the system 10 and method examples described herein.

As depicted in FIG. 17A, the perforating assembly 22 is similar in many respects to the perforating assembly example of FIGS. 16A & B. However, the container 78 enclosing the diverters 42 is secured along the tether 76 between the flow restrictor 34 and the remainder of the perforating assembly 22. Note that the explosive device or shaped charge 80 is included with the container 78 and is connected to the tether 76 for activating the charge 80 to release the diverters 42 into the flow passage 26 between the flow restrictor 34 and the perforator 28.

Figure 17B:
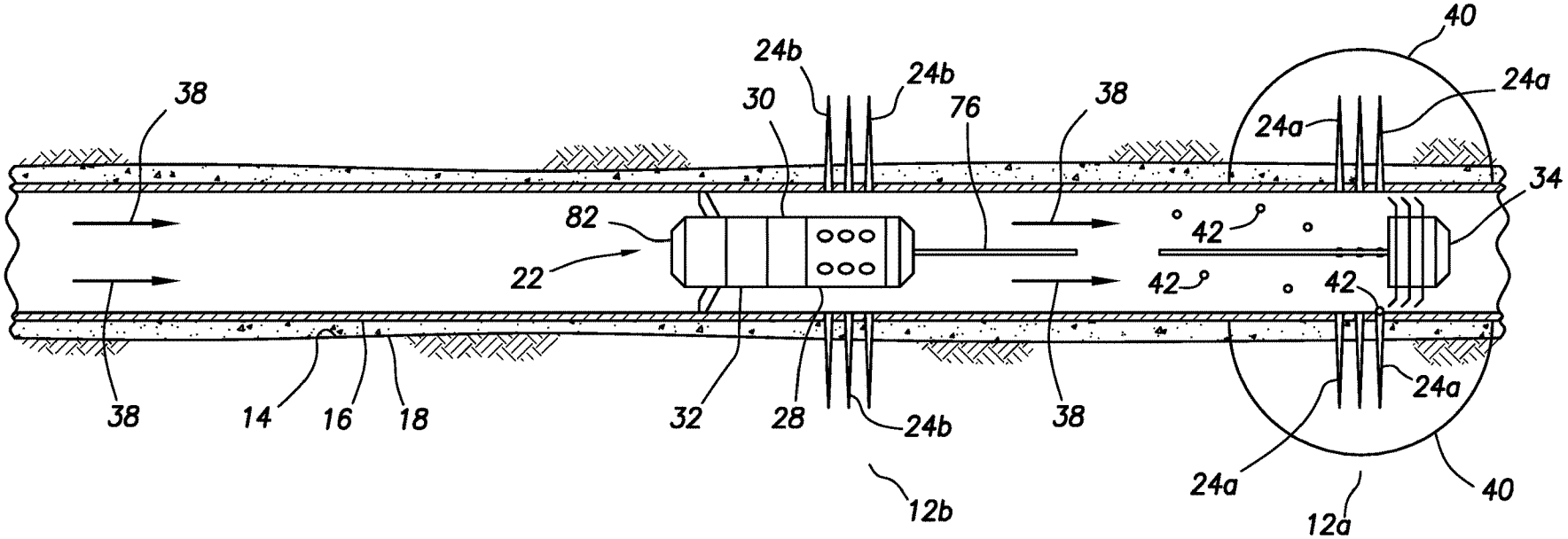

As depicted in FIG. 17B, the perforator 28 has been positioned at the desired location for forming new perforations 24*b*. This positioning may be accomplished using any of the methods described herein. For example, a predetermined volume of the fluid 38 may be flowed through the passage 26, or pumping of the fluid 38 may be ceased when the collar locator 74 (see FIG. 2) has detected a predetermined number of casing collars 75 (see FIGS. 1A-D), or the perforating assembly 22 may be provided with the pressure sensors 68*a,b* and/or acoustic sensor 122 for detecting the proximity of the open perforations 24*a* as described above for the FIGS. 16A & B example. However, the scope of this disclosure is not limited to any particular method(s) used to position the perforator 28 at the desired location for forming the perforations 24*b*.

The perforator 28 is fired after the perforator is positioned at the desired location for forming the new perforations 24*b*. The perforator 28 may be fired using any of the methods described herein. For example, the control module 32 may close the switch 56 (see FIG. 2) in response to a pressure pulse signal transmitted from the telemetry control system 120 and variable flow restrictor 118 at the surface installation 92 (see FIG. 14), or in response to the perforating assembly 22 remaining motionless for a predetermined period of time (e.g., as determined using the timer 66 and based on the output of the accelerometer 72 or the collar locator 74), or in response to events, stimuli or conditions (or combination thereof) unique to a particular well completion, including unique to a particular zone to be perforated, as sensed using any of the sensors 68, 68*a,b*, 70, 72, 74. However, the scope of this disclosure is not limited to any particular method(s) used to initiate firing of the perforator 28, and it is not necessary for the perforator to be motionless prior to the perforator being fired.

Simultaneous with firing of the perforator 28, the charge 80 may also be detonated, in order to release the diverters 42 into the flow passage 26. Alternatively, the diverters 42 could be released from the container 78 in response to firing of the perforator 28. For example, the container 78 could be opened, fractured or dispersed in response to a shock wave or pressure wave caused by the firing of the perforator 28.

Note that the diverters 42 are released into the flow passage 26 "below" or downhole of the perforator 28 and the newly formed perforations 24*b*. In this manner, the fluid flow 38 used to fracture or otherwise treat the zone 12*b* will also carry the diverters 42 to the previously formed perforations 24*a*. The diverters 42 will engage the perforations 24*a* or otherwise prevent flow of the fluid 38 into the zone 12*a* and thereby divert the fluid flow to the newly formed perforations 24*b* and into the zone 12*b*, in order to fracture or otherwise treat the zone 12*b*.

In other examples, the diverters 42 may be released into the flow passage 26 prior to or after the firing of the perforator 28. Thus, the scope of this disclosure is not limited to any particular sequence of releasing the diverters 42 relative to firing the perforator 28.

In the above examples, the fluid flowed through the flow passage 26 is indicated in the drawings with reference number 38. However, it should be clearly understood that it is not necessary for the fluid 38 depicted in each of the drawings, or in each step of the described methods, to be the exact same fluid. That is, the reference number 38 is used to represent any fluid that may be used to displace a perforating assembly, diverters, etc., through the flow passage 26, or to form the fractures 40 or otherwise treat the formation 12. For example, in a stimulation operation, the fluid 38 could represent various fluids used in corresponding various stages of the operation, including but not limited to pads, fracturing fluids, gels, spacers, acids, permeability modifiers, conformance agents, brine, etc. Thus, the scope of this disclosure is not limited to use of any particular fluid, or to use of the same fluid, in the system 10 and method examples described herein.

It may now be fully appreciated that the above disclosure provides significant advancements to the arts of constructing and operating perforating systems, and controlling flow through perforations. In examples described above, multiple zones can be completed economically, expeditiously and conveniently using unique configurations of the perforating assembly 22 and associated methods. In some examples, a previously perforated zone 12*a* may be treated (e.g., fractured, acidized or otherwise stimulated) while a perforating assembly 22 is being displaced by flow of the treatment fluid 38 through the passage 26, and while diverters 42 used to prevent flow into the zone 12*a* are also being displaced (e.g., with, "ahead of" or "behind" the perforating assembly) by the fluid flow.

The present disclosure provides to the art a well completion system 10. In one example, the well completion system 10 can include fluid 38 flow through a flow passage 26 of a casing 16 having first perforations 24*a* formed therein, and one or more first diverters 42*a* deployed into the flow passage 26 downhole of a perforating assembly 22. The one or more first diverters 42*a* and the perforating assembly 22 are concurrently displaced through the flow passage 26 by the fluid 38 flow.

In any of the well completion system 10 examples described herein, one or more second diverters 42*b* may be deployed into the flow passage 26 uphole of the perforating assembly 22, so that the second diverters 42*b* and the perforating assembly 22 may be concurrently displaced by the fluid 38 flow through the flow passage 26.

In any of the well completion system 10 examples described herein, the first diverters 42*a* may block the fluid 38 flow through the first perforations 24*a*.

In any of the well completion system 10 examples described herein, the perforating assembly 22 may be configured to degrade after the perforating assembly 22 forms second perforations 24*b* through the casing 16.

In any of the well completion system 10 examples described herein, one or more second diverters 42*b* may be deployed into the flow passage 26 uphole of the perforating assembly 22, and the second diverters 42*b* may block flow through the second perforations 24*b*.

In any of the well completion system 10 examples described herein, first fractures 40*a* may be formed into an earth formation 12 by the fluid 38 flow through the first perforations 24*a* concurrently with the perforating assembly 22 and the first diverters 42*a* being displaced through the flow passage 26 by the fluid 38 flow.

In any of the well completion system 10 examples described herein, the first diverters 42*a* may prevent the fluid 38 flow outward through the first perforations 24*a* after the first fractures 40*a* are formed, and the fluid 38 flow may be thereby diverted to flow outward through second perforations 24*b* formed by the perforator 28.

In any of the well completion system 10 examples described herein, second fractures 40*b* may be formed by the fluid 38 flow outward through the second perforations 24*b*.

In any of the well completion system 10 examples described herein, the first diverters 42*a* may be contained in a container 78, and the first diverters 42*a* may be released from the container 78 downhole prior to, simultaneously with or after second perforations 24*b* are formed through the casing 16 by the perforator 28.

In any of the well completion system 10 examples described herein, the perforating assembly 22 may include a flow restrictor 34 that restricts flow through an annulus 36 formed between the perforating assembly 22 and the casing 16.

In any of the well completion system 10 examples described herein, the perforating assembly 22 may be displaced by the fluid 38 flow to a desired location along the flow passage 26, and a perforator 28 of the perforating assembly 22 may fire only if the perforating assembly 22 remains motionless at the desired location for a predetermined period of time.

In any of the well completion system 10 examples described herein, the perforating assembly 22 may include a collar locator 74, and a perforator 28 of the perforating assembly 22 may fire only if the collar locator 74 detects a predetermined number of casing collars 75.

In any of the well completion system 10 examples described herein, the perforating assembly 22 may include a collar locator 74, and a perforator 28 of the perforating assembly 22 may fire only if an output of the collar locator 74 indicates that the perforating assembly 22 has remained motionless at the desired location for a predetermined period of time.

In any of the well completion system 10 examples described herein, the first diverters 42*a* may be retained between a flow restrictor 34 and a perforator 28 of the perforating assembly 22.

In any of the well completion system 10 examples described herein, the first diverters 42*a* may be contained in a container 78 between the flow restrictor 34 and a perforator 28 of the perforating assembly 22.

In any of the well completion system 10 examples described herein, the first diverters 42*a* may be contained in a container 78 that is configured to degrade downhole and release the first diverters 42*a* from the container 78.

In any of the well completion system 10 examples described herein, a flow restrictor 34 may be connected to the perforating assembly 22 by a tether 76.

In any of the well completion system 10 examples described herein, the first diverters 42*a* may be releasably attached to the tether 76.

In any of the well completion system 10 examples described herein, the first diverters 42*a* may be released from the tether 76 downhole.

In any of the well completion system 10 examples described herein, the perforating assembly 22 may include a drag device 82 that frictionally engages an interior surface of the casing 16 as the perforating assembly 22 displaces through the flow passage 26.

In any of the well completion system 10 examples described herein, the perforating assembly 22 may include at least one sensor 68*a,b*, 122 that detects the fluid 38 flow out of the first perforations 24*a* at a location longitudinally spaced apart along the flow passage 26 from a perforator 28 of the perforating assembly 22.

In any of the well completion system 10 examples described herein, the at least one sensor may comprise an acoustic sensor 122.

In any of the well completion system 10 examples described herein, the at least one sensor may comprise first and second pressure sensors 68*a,b* longitudinally spaced apart along the flow passage 26.

In any of the well completion system 10 examples described herein, the perforator 28 may be positioned at a desired location for forming second perforations 24*b* when the at least one sensor 68*a,b*, 122 detects the fluid 38 flow out of the first perforations 24*a*.

In any of the well completion system 10 examples described herein, the well completion system 10 may include a telemetry control system 120 that sends a signal to the perforating assembly 22 downhole.

In any of the well completion system 10 examples described herein, the signal may comprise a pressure pulse signal.

In any of the well completion system 10 examples described herein, a perforator 28 of the perforating assembly 22 may fire in response to receipt of the signal by a control module 32 of the perforating assembly 22.

A well completion method is also provided to the art by the present disclosure. In one example, the method can include the steps of: flowing fluid 38 through a flow passage 26 of a casing 16 lining a wellbore 14; deploying one or more diverters 42 and a perforating assembly 22 into the flow passage 26; displacing the diverters 42 and the perforating assembly 22 together through the flow passage 26 by the fluid 38 flow; and ceasing the fluid 38 flow, thereby placing a perforator 28 of the perforating assembly 22 at a desired location for forming new perforations 24*b* through the casing 16.

In any of the well completion method examples described herein, the deploying step may comprise deploying the diverters 42 into the flow passage 26 prior to deploying the perforating assembly 22 into the flow passage 26, so that the diverters 42 precede the perforating assembly 22 through the flow passage 26.

In any of the well completion method examples described herein, the deploying step may comprise deploying the diverters 42 into the flow passage 26 after deploying the perforating assembly 22 into the flow passage 26, so that the diverters 42 follow the perforating assembly 22 through the flow passage 26.

In any of the well completion method examples described herein, the diverters 42 may block the fluid flow through the new perforations 24*b*.

In any of the well completion method examples described herein, the ceasing step may comprise the diverters 42 blocking the fluid 38 flow through the new perforations 24*b*.

In any of the well completion method examples described herein, the method may include the perforating assembly 22 degrading downhole after the perforating assembly 22 forms the new perforations 24*b* through the casing 16.

In any of the well completion method examples described herein, the method may include forming first fractures 40*a* into an earth formation 12 by the fluid 38 flow, the first fractures 40*a* forming concurrently with the displacing of the perforating assembly 22 and the diverters 42 through the flow passage 26 by the fluid 38 flow.

In any of the well completion method examples described herein, the diverters 42 may prevent the fluid 38 flow outward through existing perforations 24*a* after the first fractures 40*a* are formed, and the fluid 38 flow may be thereby diverted to flow outward through the new perforations 24*b* formed by the perforator 28.

In any of the well completion method examples described herein, second fractures 40*b* may be formed by the fluid 38 flow outward through the new perforations 24*b*.

In any of the well completion method examples described herein, the diverters 42 may be contained in a container 78, and the diverters 42 may be released from the container 78 downhole prior to, simultaneously with or after the new perforations 24*b* are formed through the casing 16 by the perforator 28.

In any of the well completion method examples described herein, the flowing step may comprise restricting the fluid 38 flow through an annulus 36 formed between the perforating assembly 22 and the casing 16.

In any of the well completion method examples described herein, the method may include firing the perforator 28 in response to the perforating assembly 22 remaining motionless at the desired location for a predetermined period of time.

In any of the well completion method examples described herein, the perforating assembly 22 may include a collar locator 74, and may include firing the perforator 28 in response to the collar locator 74 detecting a predetermined number of casing collars 75.

In any of the well completion method examples described herein, the perforating assembly 22 may include a collar locator 74, and may include firing the perforator 28 only if an output of the collar locator 74 indicates that the perforating assembly 22 has remained motionless at the desired location for a predetermined period of time.

In any of the well completion method examples described herein, the method may include retaining the diverters 42 between a flow restrictor 34 and the perforator 28.

In any of the well completion method examples described herein, the method may include containing the diverters 42 in a container 78 between the flow restrictor 34 and the perforating assembly 22.

In any of the well completion method examples described herein, the method may include containing the diverters 42 in a container 78, and degrading the container 78 downhole, thereby releasing the diverters 42 from the container 78.

In any of the well completion method examples described herein, the method may include connecting a flow restrictor 34 to a remainder of the perforating assembly 22 by a tether 76.

In any of the well completion method examples described herein, the method may include releasably attaching the diverters 42 to the tether 76.

In any of the well completion method examples described herein, the method may include releasing the diverters 42 from the tether 76 downhole.

In any of the well completion method examples described herein, the perforating assembly 22 may include a drag device 82, and the displacing step may comprise the drag device 82 frictionally engaging an interior surface of the casing 16 as the perforating assembly 22 displaces through the flow passage 26.

In any of the well completion method examples described herein, the perforating assembly 22 may include at least one sensor 68*a,b*, 122, and the method may include the at least one sensor 68*a,b*, 122 detecting the fluid 38 flow out of existing perforations 24*a* at a location longitudinally spaced apart along the flow passage 26 from the perforator 28.

In any of the well completion method examples described herein, the detecting step may comprise the at least one sensor 122 detecting acoustic noise due to the fluid 38 flow through the existing perforations 24*a*.

In any of the well completion method examples described herein, the at least one sensor may comprise first and second pressure sensors 68*a,b* longitudinally spaced apart along the flow passage 26.

In any of the well completion method examples described herein, the perforator 28 may be positioned at the desired location for forming the new perforations 24*b* when the at least one sensor 68*a,b*, 122 detects the fluid 38 flow out of the existing perforations 24*a*.

In any of the well completion method examples described herein, the method may include a telemetry control system 120 sending a signal to the perforating assembly 22 downhole.

In any of the well completion method examples described herein, the sending step may comprise generating a pressure pulse signal.

In any of the well completion method examples described herein, the method may include the perforator 28 firing and thereby forming the new perforations 24*b* in response to receipt of the signal at the perforating assembly 22.

A perforating assembly 22 for use in a subterranean well is provided to the art by the present disclosure. In one example, the perforating assembly 22 can include a perforator 28, and a control module 32 including a memory 64, a motion sensor 72, 74, a timer 66, and a controller 62 that causes the perforator 28 to fire in response to a lack of motion sensed by the motion sensor 72, 74 for a predetermined period of time.

In any of the perforating assembly 22 examples described herein, the perforating assembly 22 may include a collar locator 74, and the controller 62 may cause the perforator 28 to fire in response to the lack of motion sensed by the motion sensor 72 for the predetermined period of time after detection of a predetermined number of casing collars 75 by the collar locator 74.

In any of the perforating assembly 22 examples described herein, the perforating assembly 22 may include a collar locator 74, and the perforator 28 of the perforating assembly 22 may fire only if the collar locator 74 detects a predetermined number of casing collars 75.

In any of the perforating assembly 22 examples described herein, the perforating assembly 22 may include a collar locator 74, and the perforator 28 of the perforating assembly 22 may fire only if an output of the collar locator 74 indicates that the perforating assembly 22 has remained motionless for a predetermined period of time.

In any of the perforating assembly 22 examples described herein, one or more diverters 42 may be retained between a flow restrictor 34 and the perforator 28 of the perforating assembly 22.

In any of the perforating assembly 22 examples described herein, the diverters 42 may be contained in a container 78 between the flow restrictor 34 and the perforating assembly 22.

In any of the perforating assembly 22 examples described herein, the container 78 may be configured to degrade downhole and release the diverters 42 from the container 78.

In any of the perforating assembly 22 examples described herein, a flow restrictor 34 may be connected to a remainder of the perforating assembly 22 by a tether 76.

In any of the perforating assembly 22 examples described herein, one or more diverters 42 may be releasably attached to the tether 76.

In any of the perforating assembly 22 examples described herein, the perforating assembly 22 may include a drag device 82 configured to frictionally engage an interior surface of a casing 16.

Another perforating assembly 22 for use in a subterranean well provided to the art by the present disclosure can include a perforator 28, and one or more diverters 42 attached to the perforator 28.

In any of the perforating assembly 22 examples described herein, the diverters 42 may be attached exterior to the perforator 28.

In any of the perforating assembly 22 examples described herein, the diverters 42 may be secured to an outer housing 46 of the perforating assembly 22.

In any of the perforating assembly 22 examples described herein, the diverters 42 may be retained between a flow restrictor 34 and the perforator 28.

In any of the perforating assembly 22 examples described herein, the diverters 42 may be contained in a container 78 between the flow restrictor 34 and the perforating assembly 22.

In any of the perforating assembly 22 examples described herein, the container 78 may be configured to degrade downhole and release the diverters 42 from the container 78.

In any of the perforating assembly 22 examples described herein, a flow restrictor 34 may be connected to the perforating assembly 22 by a tether 76.

In any of the perforating assembly 22 examples described herein, the diverters 42 may be releasably attached to the tether 76.

In any of the perforating assembly 22 examples described herein, the perforating assembly 22 may include a control module 32 including a memory 64, a motion sensor 72, 74, a timer 66, and a controller 62 that causes the perforator 28 to fire in response to a lack of motion sensed by the motion sensor 72, 74 for a predetermined period of time.

In any of the perforating assembly 22 examples described herein, the perforating assembly 22 may include a collar locator 74, and the controller 62 may cause the perforator 28 to fire in response to the lack of motion sensed by the motion sensor 72 for the predetermined period of time after detection of a predetermined number of casing collars 75 by the collar locator 74.

In any of the perforating assembly 22 examples described herein, the perforating assembly 22 may include a collar locator 74, and the perforator 28 of the perforating assembly 22 may fire only if the collar locator 74 detects a predetermined number of casing collars 75.

Another well completion method provided to the art by the present disclosure can include the steps of: flowing fluid 38 through a flow passage 26 of a casing 16 lining a wellbore 14; deploying a perforating assembly 22 into the flow passage 26; displacing the perforating assembly 22 through the flow passage 26 by the fluid 38 flow at a predetermined flow rate for a predetermined flow time; and ceasing the fluid 38 flow at an end of the predetermined flow time, thereby placing a perforator 28 of the perforating assembly 22 at a desired location for forming perforations 24 through the casing 16.

In any of the well completion method examples described herein, the method may include displacing a plug 114 to a predetermined location along the flow passage 26, thereby determining a volume of the fluid 38 corresponding to displacement of the perforating assembly 22 to the desired location along the flow passage 26.

In any of the well completion method examples described herein, the predetermined location may comprise a restriction 116 in the flow passage 26.

In any of the well completion method examples described herein, the deploying may comprise deploying one or more diverters 42 into the flow passage 26 prior to deploying the perforating assembly 22 into the flow passage 26, so that the diverters 42 precede the perforating assembly 22 through the flow passage 26.

In any of the well completion method examples described herein, the deploying step may comprise deploying one or more diverters 42 into the flow passage 26 after deploying the perforating assembly 22 into the flow passage 26, so that the diverters 42 follow the perforating assembly 22 through the flow passage 26.

In any of the well completion method examples described herein, the ceasing step may comprise one or more diverters 42 blocking the fluid 38 flow through the perforations 24 in the casing 16.

In any of the well completion method examples described herein, the method may include the perforating assembly 22 degrading downhole after the perforating assembly 22 forms the perforations 24 through the casing 16.

In any of the well completion method examples described herein, the method may include forming fractures 40 into an earth formation 12 by the fluid 38 flow concurrently with the displacing of the perforating assembly 22 through the flow passage 26 by the fluid 38 flow.

In any of the well completion method examples described herein, the flowing step may comprise restricting the fluid 38 flow through an annulus 36 formed between the perforating assembly 22 and the casing 16.

In any of the well completion method examples described herein, the method may include firing the perforator 28 in response to the perforating assembly 22 remaining motionless at the desired location for a predetermined period of time.

In any of the well completion method examples described herein, the perforating assembly 22 may include a collar locator 74, and the method may include firing the perforator 28 in response to the collar locator 74 detecting a predetermined number of casing collars 75.

In any of the well completion method examples described herein, the method may include retaining one or more diverters 42 between a flow restrictor 34 and the perforator 28.

In any of the well completion method examples described herein, the method may include containing the diverters 42 in a container 78 between the flow restrictor 34 and the perforator 28.

In any of the well completion method examples described herein, the method may include containing the diverters 42 in a container 78, and degrading the container 78 downhole, thereby releasing the diverters 42 from the container 78.

In any of the well completion method examples described herein, the method may include connecting a flow restrictor 34 to the perforating assembly 22 by a tether 76.

In any of the well completion method examples described herein, the method may include releasably attaching one or more diverters 42 to the tether 76.

In any of the well completion method examples described herein, the method may include releasing the diverters 42 from the tether 76 downhole.

In any of the well completion method examples described herein, the perforating assembly 22 may be displaced to the desired location, without use of a collar locator 74.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well completion system, comprising:

fluid flow through a flow passage of a casing having first perforations formed therein; and one or more first diverters deployed into the flow passage downhole of a perforating assembly, in which the one or more first diverters are deployed separately from the perforating assembly, and in which the one or more first diverters and the perforating assembly are concurrently displaced through the flow passage by the fluid flow.

2. The well completion system of claim 1, in which one or more second diverters are deployed into the flow passage uphole of the perforating assembly, so that the second diverters and the perforating assembly are concurrently displaced by the fluid flow through the flow passage.

3. The well completion system of claim 1, in which the first diverters block the fluid flow through the first perforations.

4. The well completion system of claim 3, in which the perforating assembly is configured to degrade after the perforating assembly forms second perforations through the casing.

5. The well completion system of claim 4, in which one or more second diverters are deployed into the flow passage uphole of the perforating assembly, and the second diverters block flow through the second perforations.

6. The well completion system of claim 1, in which first fractures are formed into an earth formation by the fluid flow through the first perforations concurrently with the perforating assembly and the first diverters being displaced through the flow passage by the fluid flow.

7. The well completion system of claim 6, in which the first diverters prevent the fluid flow outward through the first perforations after the first fractures are formed, and the fluid flow is thereby diverted to flow outward through second perforations formed by a perforator of the perforating assembly.

8. The well completion system of claim 7, in which second fractures are formed by the fluid flow outward through the second perforations.

9. The well completion system of claim 1, in which the first diverters are contained in a container, and the first diverters are released from the container downhole prior to, simultaneously with or after second perforations being formed through the casing by the perforator.

10. The well completion system of claim 1, in which the perforating assembly includes a flow restrictor that restricts flow through an annulus formed between the perforating assembly and the casing.

11. The well completion system of claim 1, in which the perforating assembly is displaced by the fluid flow to a desired location along the flow passage, and a perforator of the perforating assembly fires only if the perforating assembly remains motionless at the desired location for a predetermined period of time.

12. The well completion system of claim 1, in which the perforating assembly includes a collar locator, and a perforator of the perforating assembly fires only if the collar locator detects a predetermined number of casing collars.

13. The well completion system of claim 1, in which the perforating assembly includes a collar locator, and a perforator of the perforating assembly fires only if an output of the collar locator indicates that the perforating assembly has remained motionless at the desired location for a predetermined period of time.

14. The well completion system of claim 1, in which the first diverters are retained between a flow restrictor and a perforator of the perforating assembly.

15. The well completion system of claim 14, in which the first diverters are contained in a container between the flow restrictor and a perforator of the perforating assembly.

16. The well completion system of claim 14, in which the first diverters are contained in a container that is configured to degrade downhole and release the first diverters from the container.

17. The well completion system of claim 1, in which a flow restrictor is connected to the perforating assembly by a tether.

18. The well completion system of claim 17, in which the first diverters are releasably attached to the tether.

19. The well completion system of claim 18, in which the first diverters are released from the tether downhole.

20. The well completion system of claim 17, in which the perforating assembly includes a drag device that frictionally engages an interior surface of the casing as the perforating assembly displaces through the flow passage.

21. The well completion system of claim 1, in which the perforating assembly includes at least one sensor that detects the fluid flow out of the first perforations at a location longitudinally spaced apart along the flow passage from a perforator of the perforating assembly.

22. The well completion system of claim 21, in which the at least one sensor comprises an acoustic sensor.

23. The well completion system of claim 21, in which the at least one sensor comprises first and second pressure sensors longitudinally spaced apart along the flow passage.

24. The well completion system of claim 21, in which the perforator is positioned at a desired location for forming second perforations when the at least one sensor detects the fluid flow out of the first perforations.

25. The well completion system of claim 1, further comprising a telemetry control system that sends a signal to the perforating assembly downhole.

26. The well completion system of claim 25, in which the signal comprises a pressure pulse signal.

27. The well completion system of claim 25, in which a perforator of the perforating assembly fires in response to receipt of the signal by a control module of the perforating assembly.

28. A well completion method, comprising:

flowing fluid through a flow passage of a casing lining a wellbore;

deploying one or more diverters and a perforating assembly into the flow passage, in which the perforating assembly includes at least one sensor;

displacing the diverters and the perforating assembly together through the flow passage by the fluid flow;

the at least one sensor detecting the fluid flow out of existing perforations at a location longitudinally spaced apart along the flow passage from the perforator; and ceasing the fluid flow, thereby placing a perforator of the perforating assembly at a desired location for forming new perforations through the casing.

29. The well completion method of claim 28, in which the deploying comprises deploying the diverters into the flow passage prior to deploying the perforating assembly into the flow passage, so that the diverters precede the perforating assembly through the flow passage.

30. The well completion method of claim 28, in which the deploying comprises deploying the diverters into the flow passage after deploying the perforating assembly into the flow passage, so that the diverters follow the perforating assembly through the flow passage.

31. The well completion method of claim 28, further comprising the diverters blocking the fluid flow through the new perforations.

32. The well completion method of claim 28, in which the ceasing comprises the diverters blocking the fluid flow through the new perforations.

33. The well completion method of claim 28, further comprising the perforating assembly degrading downhole after the perforating assembly forms the new perforations through the casing.

34. The well completion method of claim 28, further comprising forming first fractures into an earth formation by the fluid flow, the first fractures forming concurrently with the displacing of the perforating assembly and the diverters through the flow passage by the fluid flow.

35. The well completion method of claim 34, in which the diverters prevent the fluid flow outward through existing perforations after the first fractures are formed, and the fluid flow is thereby diverted to flow outward through the new perforations formed by the perforator.

36. The well completion method of claim 35, in which second fractures are formed by the fluid flow outward through the new perforations.

37. The well completion method of claim 28, in which the diverters are contained in a container, and the diverters are released from the container downhole prior to, simultaneously with or after the new perforations being formed through the casing by the perforator.

38. The well completion method of claim 28, in which the flowing further comprises restricting the fluid flow through an annulus formed between the perforating assembly and the casing.

39. The well completion method of claim 28, further comprising firing the perforator in response to the perforating assembly remaining motionless at the desired location for a predetermined period of time.

40. The well completion method of claim 28, in which the perforating assembly includes a collar locator, and further comprising firing the perforator in response to the collar locator detecting a predetermined number of casing collars.

41. The well completion method of claim 28, in which the perforating assembly includes a collar locator, and further comprising firing the perforator only if an output of the collar locator indicates that the perforating assembly has remained motionless at the desired location for a predetermined period of time.

42. The well completion method of claim 28, further comprising retaining the diverters between a flow restrictor and the perforator.

43. The well completion method of claim 42, further comprising containing the diverters in a container between the flow restrictor and the perforating assembly.

44. The well completion method of claim 28, further comprising containing the diverters in a container, and degrading the container downhole, thereby releasing the diverters from the container.

45. The well completion method of claim 28, further comprising connecting a flow restrictor to a remainder of the perforating assembly by a tether.

46. The well completion method of claim 45, further comprising releasably attaching the diverters to the tether.

47. The well completion method of claim 46, further comprising releasing the diverters from the tether downhole.

48. The well completion method of claim 45, in which the perforating assembly includes a drag device, and in which the displacing further comprises the drag device frictionally engaging an interior surface of the casing as the perforating assembly displaces through the flow passage.

49. The well completion method of claim 28, in which the detecting comprises the at least one sensor detecting acoustic noise due to the fluid flow through the existing perforations.

50. The well completion method of claim 28, in which the at least one sensor comprises first and second pressure sensors longitudinally spaced apart along the flow passage.

51. The well completion method of claim 28, in which the perforator is positioned at the desired location for forming the new perforations when the at least one sensor detects the fluid flow out of the existing perforations.

52. The well completion method of claim 28, further comprising a telemetry control system sending a signal to the perforating assembly downhole.

53. The well completion method of claim 52, in which the sending comprises generating a pressure pulse signal.

54. The well completion method of claim 52, further comprising the perforator firing and thereby forming the new perforations in response to receipt of the signal at the perforating assembly.

55. A perforating assembly for use in a subterranean well, the perforating assembly comprising:

a perforator;

one or more diverters retained between a flow restrictor and the perforator of the perforating assembly; and a control module including a memory, a motion sensor, a timer, and a controller that causes the perforator to fire in response to a lack of motion sensed by the motion sensor for a predetermined period of time.

56. The perforating assembly of claim 55, further comprising a collar locator, and in which the controller causes the perforator to fire in response to the lack of motion sensed by the motion sensor for the predetermined period of time after detection of a predetermined number of casing collars by the collar locator.

57. The perforating assembly of claim 55, further comprising a collar locator, and in which the perforator of the perforating assembly fires only if the collar locator detects a predetermined number of casing collars.

58. The perforating assembly of claim 55, further comprising a collar locator, and in which the perforator of the perforating assembly fires only if an output of the collar locator indicates that the perforating assembly has remained motionless for a predetermined period of time.

59. The perforating assembly of claim 55, in which the diverters are contained in a container between the flow restrictor and the perforating assembly.

60. The perforating assembly of claim 59, in which the container is configured to degrade downhole and release the diverters from the container.

61. The perforating assembly of claim 55, in which the flow restrictor is connected to a remainder of the perforating assembly by a tether.

62. The perforating assembly of claim 61, in which the one or more diverters are releasably attached to the tether.

63. The perforating assembly of claim 61, further comprising a drag device configured to frictionally engage an interior surface of a casing.

64. A perforating assembly for use in a subterranean well, the perforating assembly comprising:

a perforator;

a flow restrictor connected by a first tether to a first end of the perforator; and a drag device connected by a second tether to a second end of the perforator opposite the first end, in which one or more diverters are configured to displace with the perforating assembly.

65. The perforating assembly of claim 64, in which the diverters are attached exterior to the perforator.

66. The perforating assembly of claim 64, in which the diverters are secured to an outer housing of the perforating assembly.

67. The perforating assembly of claim 64, in which the diverters are retained between the flow restrictor and the perforator.

68. The perforating assembly of claim 64, in which the diverters are contained in a container between the flow restrictor and the perforating assembly.

69. The perforating assembly of claim 68, in which the container is configured to degrade downhole and release the diverters from the container.

70. The perforating assembly of claim 64, in which the diverters are releasably attached to the first tether.

71. The perforating assembly of claim 64, further comprising a control module including a memory, a motion sensor, a timer, and a controller that causes the perforator to fire in response to a lack of motion sensed by the motion sensor for a predetermined period of time.

72. The perforating assembly of claim 71, further comprising a collar locator, and in which the controller causes the perforator to fire in response to the lack of motion sensed by the motion sensor for the predetermined period of time after detection of a predetermined number of casing collars by the collar locator.

73. The perforating assembly of claim 71, further comprising a collar locator, and in which the perforator of the perforating assembly fires only if the collar locator detects a predetermined number of casing collars.

74. A well completion method, comprising:

flowing fluid through a flow passage of a casing lining a wellbore;

displacing a plug to a predetermined location along the flow passage, thereby determining a volume of the fluid corresponding to displacement of a perforating assembly to a desired location along the flow passage;

deploying the perforating assembly into the flow passage;

displacing the perforating assembly through the flow passage by the fluid flow at a predetermined flow rate for a predetermined flow time;

ceasing the fluid flow at an end of the predetermined flow time, thereby placing a perforator of the perforating assembly at the desired location; and forming perforations through the casing.

75. The well completion method of claim 74, in which the predetermined location comprises a restriction in the flow passage.

76. The well completion method of claim 74, in which the deploying comprises deploying one or more diverters into the flow passage prior to deploying the perforating assembly into the flow passage, so that the diverters precede the perforating assembly through the flow passage.

77. The well completion method of claim 74, in which the deploying comprises deploying one or more diverters into the flow passage after deploying the perforating assembly into the flow passage, so that the diverters follow the perforating assembly through the flow passage.

78. The well completion method of claim 74, in which the ceasing comprises one or more diverters blocking the fluid flow through the perforations in the casing.

79. The well completion method of claim 74, further comprising the perforating assembly degrading downhole after the perforating assembly forms the perforations through the casing.

80. The well completion method of claim 74, further comprising forming fractures into an earth formation by the fluid flow concurrently with the displacing of the perforating assembly through the flow passage by the fluid flow.

81. The well completion method of claim 74, in which the flowing further comprises restricting the fluid flow through an annulus formed between the perforating assembly and the casing.

82. The well completion method of claim 74, further comprising firing the perforator in response to the perforating assembly remaining motionless at the desired location for a predetermined period of time.

83. The well completion method of claim 74, in which the perforating assembly includes a collar locator, and further comprising firing the perforator in response to the collar locator detecting a predetermined number of casing collars.

84. The well completion method of claim 74, further comprising retaining one or more diverters between a flow restrictor and the perforator.

85. The well completion method of claim 84, further comprising containing the diverters in a container between the flow restrictor and the perforator.

86. The well completion method of claim 74, further comprising containing the diverters in a container, and degrading the container downhole, thereby releasing the diverters from the container.

87. The well completion method of claim 74, further comprising connecting a flow restrictor to the perforating assembly by a tether.

88. The well completion method of claim 87, further comprising releasably attaching one or more diverters to the tether.

89. The well completion method of claim 88, further comprising releasing the diverters from the tether downhole.

90. The well completion method of claim 74, in which the perforating assembly is displaced to the desired location, without use of a collar locator.

* * * * *